US006485875B1

(12) United States Patent
Karaki et al.

(10) Patent No.: US 6,485,875 B1
(45) Date of Patent: Nov. 26, 2002

(54) TONER AND RESIN COMPOSITION FOR THE TONER

(75) Inventors: Yuki Karaki, Shizuoka-ken; Hiroshi Yusa, Machida; Takashige Kasuya; Yoshihiro Ogawa, both of Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/696,296

(22) Filed: Oct. 26, 2000

(30) Foreign Application Priority Data

Oct. 26, 1999 (JP) ..... 11-303335
Jan. 18, 2000 (JP) ..... 2000-008460

(51) Int. Cl.[7] ..... G03G 9/087

(52) U.S. Cl. ..... 430/108.23; 430/109.3; 430/109.4; 430/108.3; 524/10; 524/43; 524/165; 524/444; 524/445

(58) Field of Search ..... 430/109.3, 109.4, 430/108.23, 108.3; 524/445, 444, 165, 10, 43

(56) References Cited

U.S. PATENT DOCUMENTS

| | | | | |
|---|---|---|---|---|
| 2,297,691 A | | 10/1942 | Carlson | 95/5 |
| 3,666,363 A | | 5/1972 | Tanaka et al. | 355/17 |
| 4,071,361 A | | 1/1978 | Marushima | 96/1.4 |
| 4,246,332 A | | 1/1981 | Tanaka et al. | 430/109 |
| 5,135,833 A | | 8/1992 | Matsunaga et al. | 430/110 |
| 5,518,850 A | * | 5/1996 | Bayley et al. | 524/445 |
| 5,840,457 A | | 11/1998 | Urawa et al. | 430/45 |
| 5,902,709 A | * | 5/1999 | Nakayama et al. | 524/444 |
| 5,948,584 A | * | 9/1999 | Hashimoto et al. | 430/109.3 |
| 5,972,553 A | | 10/1999 | Katada et al. | 430/110 |
| 5,976,752 A | | 11/1999 | Matsunaga et al. | 430/110 |
| 6,232,027 B1 | * | 5/2001 | Matsunaga et al. | 430/109.3 |

FOREIGN PATENT DOCUMENTS

| | | |
|---|---|---|
| JP | 54-114245 | 9/1979 |
| JP | 56-116043 | 9/1981 |
| JP | 58-102246 | 6/1983 |
| JP | 58-159546 | 9/1983 |
| JP | 1-156759 | 6/1989 |
| JP | 2-0881 | 1/1990 |
| JP | 4-338973 | 11/1992 |
| JP | 8-44108 | 2/1996 |
| JP | 8-54754 | 2/1996 |
| JP | 8-166688 | 6/1996 |

* cited by examiner

*Primary Examiner*—Christopher Rodee
(74) *Attorney, Agent, or Firm*—Fitzpatrick, Cella, Harper & Scinto

(57) ABSTRACT

A toner is constituted by at least a binder resin, a colorant and a wax. The binder resin has been formed from monomers including a vinyl monomer and polyester-forming monomers containing at least a polybasic carboxylic acid having three or more carboxyl groups or its anhydride, and comprises at least a hybrid resin comprising a vinyl polymer unit and a polyester unit.

42 Claims, No Drawings

TONER AND RESIN COMPOSITION FOR THE TONER

FIELD OF THE INVENTION AND RELATED ART

The present invention relates to a toner used in an image forming method utilizing electrophotography, electrostatic recording, electrostatic printing or a recording method utilizing toner jet recording, and a resin composition for the toner.

Hitherto, a large number of electrophoto-graphic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., via or without via an intermediate transfer member, as desired, fixed by heating, pressing, or heating and pressing, or with solvent vapor to obtain a copy or print carrying a fixed toner image.

As for the step of fixing the toner image onto a sheet material such as paper which is the final step in the above process, the most popular fixing method is a heating and pressing fixation system using hot rollers.

In the heating and pressing system, a sheet carrying a toner image to be fixed (hereinafter called "fixation sheet") is passed through hot rollers, while a surface of a hot roller having a releasability with the toner is caused to contact the toner image surface of the fixation sheet under pressure, to fix the toner image. In this method, as the hot roller surface and the toner image on the fixation sheet contact each other under a pressure, a very good heat efficiency is attained for melt-fixing the toner image onto the fixation sheet to afford quick fixation.

In the fixing step, however, a hot roller surface and a toner image contact each other in a melted state and under a pressure, so that a part of the toner is transferred and attached to the fixing roller surface and then re-transferred to a subsequent fixation sheet to soil the fixation sheet. This is called an offset phenomenon.

Hitherto, as toner binder resins, polyester resins, and vinyl copolymers, such as styrene copolymers, have been principally used.

A polyester resin provides an excellent low-temperature fixability but is accompanied with a difficulty that it is liable to cause the high-temperature offset. For alleviating the difficulty, it has been tried to increase the viscosity of a polyester resin by increasing the molecular weight. In this case, however, the low-temperature fixability is liable to be impaired, and the pulverizability during toner production can also be impaired, thus providing a binder resin not suitable for production of smaller particle size toners.

A vinyl copolymer, such as a styrene copolymer, has excellent pulverizability suitable for toner production, and provides excellent anti-high-temperature offset performance because the molecular weight thereof can be increased easily. However, if the molecular weight is lowered in order to provide an improved low-temperature fixability, the anti-blocking property and developing performance are liable to be impaired.

In order to effectively utilize the advantages and compensate for the difficulties of the above two types of resins, several proposals have been made regarding the use of mixtures of these resins.

For example, Japanese Laid-Open Patent Application (JP-A) 54-114245 discloses a toner containing a mixture of a polyester resin and a vinyl copolymer. However, since a polyester resin and a vinyl copolymer essentially have poor mutual solubility, it is difficult to provide a toner satisfying low-temperature fixability, anti-high-temperature offset performance and anti-blocking property in combination unless a suitable mixing ratio of the resin is set.

Further, it is difficult to sufficiently improve a dispersibility of internal additives, such as a colorant and a wax, added for toner production, thus being liable to result in a problem in developing performance of the resultant toner. This difficulty is liable to be noticeable especially in production of smaller-particle size toners which are preferred in recent years.

JP-A 56-116043 and JP-A 58-159546 disclose a toner containing a polymer obtained by polymerizing a vinyl monomer in the presence of a polyester resin.

JP-A 58-102246 and JP-A 1-156759 disclose a toner containing a polymer obtained by polymerizing vinyl monomers in the presence of an unsaturated polyester.

JP-A 2-881 discloses a toner containing a polymer obtained by esterifying a polyester resin and a styrene-based resin having a specific acid value.

In the above-mentioned toners, the polyester resin and the vinyl copolymer can have an improved mutual solubility. However, it is difficult to uniformly disperse a wax added for toner production. The resultant toner still has room for improvement with respect to not only low-temperature fixability but also developing performance.

JP-A 4-338973 discloses a toner containing two species of polyester resins different in softening point and JP-A 8-166688 discloses a toner containing two species of polyester resins different in molecular weight.

Both of these toners, however, an anti-high-temperature offset performance of the resultant toner is at a level within that in the case of using an ordinary polyester resin, thus still having room for improvement.

JP-A 8-54754 discloses a toner containing a resin obtained by mixing a polyester with a specific resin prepared through addition polymerization of a vinyl monomer and polycondensation of monomers for a polyester resin performed in parallel with each other.

JP-A 8-44108 discloses a toner containing two species of specific resins different in softening point each prepared through addition polymerization of a vinyl monomer and polycondensation of monomers for a polyester resin performed in parallel with each other.

However, these toners fails to control a balance of crosslinking degree between a lower-molecular weight component and a higher-molecular weight component, thus still leaving room for improvement with respect to low-temperature fixability, dispersibility of wax, and developing performance for a long period.

U.S. Pat. No. 5,976,752 discloses a toner containing at least a binder resin, a colorant and a wax and the binder resin comprises a polyester resin, a vinyl resin, and a hybrid resin component comprising a polyester unit and a vinyl polymer unit. This toner is specified in term of THF (tetrahydrofuran) soluble and insoluble contents, ethyl acetate-soluble and -insoluble contents, chroloform-soluble and -insoluble contents, and a GPC (gel permeation chromatography) molecular weight distribution for a THF-soluble content. This toner exhibits a good low-temperature fixability and excellent anti-offset characteristic, anti-blocking characteristic and continuous image forming performance on a large number of sheets.

However, in order to further improve the low-temperature fixability while retaining the anti-offset characteristic, the anti-blocking characteristic and the continuous image forming performance, the toner has room for further improvement.

SUMMARY OF THE INVENTION

A generic object of the present invention is to provide a toner for developing electrostatic images having solved the above-mentioned problems.

A more specific object of the present invention is to provide a toner capable of exhibiting excellent low-temperature fixability and anti-high-temperature offset property and providing a good developing performance for a long period.

Another object of the present invention is to provide a toner wherein a wax is uniformly dispersed in a binder resin.

A further object of the present invention is to provide a resin composition for a toner as described above.

According to the present invention, there is provided a toner, comprising: at least a binder resin, a colorant and a wax, wherein the binder resin has been formed from monomers including a vinyl monomer and polyester-forming monomers containing at least a polybasic carboxylic acid having three or more carboxyl groups or its anhydride, and comprises at least a hybrid resin comprising a vinyl polymer unit and a polyester unit, the toner contains a THF (tetrahydrofuran)-soluble content which includes a first component having molecular weights of below $1\times10^4$ containing W1 (mol. %) of the polybasic carboxylic acid and its anhydride based on the polyester-forming monomers contained in the first component and a second component having molecular weight of at least $1\times10^4$ containing W2 (mol. %) of the polybasic carboxylic acid and its anhydride based on the polyester-forming monomers contained in the second component, W1 and W2 satisfying the following relationship:

$$0\leqq W1<30,$$

$$0<W2<50, \text{ and}$$

$$W2>W1,$$

the THF-soluble content provides a GPC (gel permeation chromatography) chromatogram including 40–70 wt. % (M1) of a component having molecular weights of below $1\times10^4$, 25–50 wt. % (M2) of a component having molecular weights of $1\times10^4$–$5\times10^4$, 2–25 wt. % (M3) of a component having molecular weights of above $5\times10^4$, and below 10 wt. % (M4) of a component having molecular weights of at least $10\times10^4$, M1, M2 and M3 satisfying the following relationship:

$$M1\geqq M2>M3.$$

According to the present invention, there is also provided a resin composition for a toner, comprising:

at least a hybrid resin comprising a vinyl polymer unit and a polyester unit, wherein the resin composition has been formed from monomers including a vinyl monomer and polyester-forming monomers containing at least a polybasic carboxylic acid having three or more carboxyl groups or its anhydride, the resin composition contains a THF (tetrahydrofuran)-soluble content which includes a first component having molecular weights of below $1\times10^4$ containing w1 (mol. %) of the polybasic carboxylic acid and its anhydride based on the polyester-forming monomers contained in the first component and a second component having molecular weight of at least $1\times10^4$ containing w2 (mol. %) of the polybasic carboxylic acid and its anhydride based on the polyester-forming monomers contained in the second component, w1 and w2 satisfying the following relationship:

$$0\leqq w1<30,$$

$$0<w2<50, \text{ and}$$

$$w2>w1,$$

the THF-soluble content provides a GPC (gel permeation chromatography) chromatogram including 40–75 wt. % (m1) of a component having molecular weights of below $1\times10^4$, 23–45 wt. % (m2) of a component having molecular weights of $1\times10^4$–$5\times10^4$, 2–25 wt. % (m3) of a component having molecular weights of above $5\times10^4$, and below 13 wt. % (m4) of a component having molecular weights of at least $10\times10^4$, m1, m2, and m3 satisfying the following relationship:

$$m1\leqq m2>m3.$$

These and other objects, features and advantages of the present invention will become more apparent upon a consideration of the following description of the preferred embodiments of the present invention.

DETAILED DESCRIPTION OF THE INVENTION

According to our study on toner performances including low-temperature fixability, anti-high-temperature offset performance and developing performance, it has been found effective to use as a binder resin for a toner at least a hybrid resin comprising a vinyl polymer unit and a polyester unit and adjust a proportion of constitutional components for a THF (tetrahydrofuran)-soluble content of the toner such that the constitutional components comprises a lower molecular weight component having molecular weights of below $1\times10^4$ containing W1 (mo. %) of a polybasic carboxylic acid having three or more carboxyl groups and/or its anhydride based on all the polyester-forming monomers contained in the lower-molecular weight component and a higher-molecular weight component having molecular weights of at least $1\times10^4$ containing W2 (mol. %) of a polybasic carboxyl acid having three or more carboxyl groups and/or its anhydride, based on all the polyester-forming monomer contained in the higher-molecular weight component, and W1 and W2 satisfy the relationships of $0\leqq W1<30$, $0<W2<50$ and $W2>W1$. W1 and W2 mean a total molar percentage (mol. %) of all the polybasic carboxylic acid component (consisting of either one or both of the polybasic carboxylic acid having three or more carboxyl group and its anhydride) actually contained in the lower-molecular weight component and the higher-molecular weight component, respectively.

As a result, it is possible to sufficiently improve not only the low-temperature fixability based on the low-molecular weight component ($<1\times10^4$) and the anti-high-temperature offset performance based on the high-molecular weight component ($\geqq1\times10^4$) in combination but also a dispersibility of a wax in a binder resin to enhance the developing performance of the resultant toner. Further, excessive crosslinking for each of the lower-molecular weight component and the higher-molecular weight component is not caused to occur, thus ensuring good low-temperature fixability, toner pulverizability and wax dispersibility. The THF-soluble content of the toner also have a specific molecular weight balancing the low-temperature fixability, anti-high-temperature offset performance and anti-blocking performance.

As described above, the toner according to the present invention contains a binder resin comprising at least the hybrid resin comprising a vinyl polymer unit and a polyester unit.

In the present invention, the binder resin may, e.g., be used in the form of a blend (mixture) comprising at least one species of hybrid resin and optional polyester resin and/or vinyl polymer including:

(i) a blend of a hybrid resin and another hybrid resin, (ii) a blend of a polyester resin and a hybrid resin, (iii) a blend of a vinyl polymer and a hybrid resin, and (iv) a blend of a vinyl polymer, a polyester resin and a hybrid resin.

Among these blends (i) to (iv), it is particularly preferred to use the blend (i) or the blend (ii) in view of relatively low dispersibility between the vinyl polymer and the hybrid resin.

Hereinbelow, as a preferred embodiment, an embodiment using the blend (i) is referred to as "first embodiment" and an embodiment using the blend (ii) is referred to as "second embodiment".

In the present invention, the higher-molecular weight component (molecular weight$\geqq1\times10^4$) contained in a THF (tetrahydrofuran)-soluble content of the toner is a component effecting the anti-high-temperature offset performance and it is important that the toner exhibits a sufficient recovery force at high temperatures. Accordingly, the higher-molecular weight component is required to be sufficiently crosslinked with a polybasic carboxylic acid having three or more carboxyl groups or its anhydride. On the other hand, the lower-molecular weight component (molecular weight$<1\times10^4$) is a component affecting the low-temperature fixability and it is important therefor to be well melted at low temperatures, thus not requiring a crosslink density compared with the higher-molecular weight component (molecular weight$\geqq1\times10^4$).

For this reason, by fulfilling the above-mentioned relationship: W2>W1 between the molar percentage W1 (mol. %) of the polybasic carboxylic acid component (based on all the polyester-forming monomers) contained in the lower-molecular weight component and the molar percentage W2 (mol. %) of the polybasic acid component contained in the higher-molecular weight component, respectively constituting the THF-soluble content of the toner according to the present invention, it is possible to increase an elastic force (recovery force) of the resultant toner based on a crosslinked structure formed with the polybasic carboxylic acid component in the higher-molecular weight component which is sufficiently crosslinked compared with the lower-molecular weight component, thus improving the anti-high-temperature offset performance. On the other hand, the lower-molecular weight component is less crosslinked compared with the higher-molecular weight component, thus being readily melted at low temperatures to be excellent in dispersibility of a wax. As a result, the resultant toner can highly realize the low-temperature fixability and the anti-high-temperature offset performance in combination and also is excellent in developing performance.

When W1 and W2 shows the relationship of W2≦W1, a fixation temperature and a dispersibility of a wax are liable to be lowered.

In the present invention, the molar percentages W1 (mol. %) and W2 (mol. %) also satisfy the following relationships, respectively:

$$0\leqq W1<30,$$

$$0<W2<50,$$

preferably:

$$1<W1<25,$$

$$2<W2<30,$$

more preferably:

$$3\leqq W1<20,$$

$$3<W2\leqq20.$$

When W1 is at least 30 (mol. %), the lower-molecular weight component is excessively crosslinked to lower the low-temperature fixability. On the other hand, when W2 is at least 50 (mol. %), the higher-molecular weight component is excessively crosslinked to impair a pulverizability of the toner and a dispersibility of wax, thus being liable to cause toner melt-sticking onto a developing sleeve and/or a photosensitive drum (member).

Further, in the preferred case of 1<W1, crosslinking of the lower-molecular weight component allows an improvement in releasability between a fixed toner image and a fixation roller. As a result, a yet-unfixed toner image can effectively be fixed without causing toner soiling of a separation claw for separating a transfer(-receiving) material from the fixation roller. In the preferred case of 2<W2, the higher-molecular weight component is crosslinked such that the resultant crosslinked structure can exhibit a sufficient anti-high-temperature offset performance of the toner.

In the present invention, W1 and W2 may preferably provides a difference therebetween (W2−W1) satisfying the following relationship:

$$0<W2-W1<10,$$

more preferably, $$0.1\times W2<W2-W1<0.5\times W2.$$

This is because the lower-molecular weight component and the higher-molecular weight component can perform respective functions in a well balanced manner and exhibit a good mutual solubility to enhance the resultant wax dispersibility.

In the first embodiment using the blend (i), the toner may preferably have a THF-insoluble content of at most 25 wt. %, more preferably 1–15 wt. %. If the THF-insoluble content exceeds 25 wt. %, the resultant toner is liable to lower its fixability and pulverizability.

In the second embodiment using the blend (ii), the toner may preferably have a THF-insoluble content of 1–50 wt. %, more preferably 2–40 wt. %, further preferably 5–30 wt. %. Below 1 wt. %, the toner is liable to lower its storability for a long period and anti-high-temperature offset performance. Above 50 wt. %, the fixability of the toner is liable to be lowered.

In the present invention, the toner contains a THF-soluble content providing a GPC (gel permeation chromatography) chromatogram including 40–70 wt. % (M1) of a component having molecular weights of below $1\times10^4$, 25–50 wt. % (M2) of a component having molecular weights of $1\times10^4$–$5\times10^4$, 2–25 wt. % (M3) of a component having molecular weights of above $5\times10^4$, and below 10 wt. % (M4) of a component having molecular weights of at least $10\times10^4$, wherein the contents M1, M2 and M3 satisfy the relationship of: $M1 \geqq M2 > M3$, in order to provide a good balance of the low-temperature fixability, anti-high-temperature offset performance and an anti-blocking performance.

If the content (M3) of the component having molecular weights of above $5\times10^4$ exceeds 25 wt. %, the low-temperature fixability is liable to be lowered. If the content (M1) of the component having molecular weights of below $1\times10^4$ exceeds 70 wt. % and the relationship ($M1 \geqq M2 > M3$) is not satisfied, the storability of the toner under high-temperature and high-humidity environment and the anti-high-temperature offset performance are liable to be deteriorated. Further, the component having molecular weights of below $1\times10^4$ is a component well melted even at low temperatures and when the content (M1) thereof is in the range of 40–70 wt. %, it is possible to provide a sufficient low-temperature fixability. The component having molecular weights of at least $5\times10^4$ is a component performing a function of providing a recovery force to the toner at high temperatures, and when the content (M3) thereof is in the range of 2–25 wt. %, the anti-high-temperature offset performance becomes good. Further, when the content (M4) of the component having molecular weights of above $10\times10^4$ is below 10 wt. %, the low-temperature fixability of the toner is not impaired. In order to provide a good developing performance, the content (M2) of the component having molecular weights of $1\times10^4$–$5\times10^4$ is in the range of 25–5 wt. %, thus effectively dispersing particles of colorant, charge control agent and magnetic material in the binder resin to provide a uniform chargeability.

In the present invention, the molecular weight (distribution) of the THF-soluble content in the toner may be measured based on a chromatogram obtained by GPC (gel permeation chromatography).

More specifically, a toner is subjected to extraction with THF (tetrahydrofuran) for 10 hours by using a Soxhlet extractor to prepare a GPC sample solution. The GPC sample solution was injected in a GPC apparatus. For measurement, it is appropriate to constitute the column as a combination of commercially available polystyrene gel columns (Shodex A-801, 802, 803, 804, 85, 806 and 807, mfd. by Showa Denko K.K.). The identification of sample molecular weight and its molecular weight distribution is performed based on a calibration curve obtained by using standard polystyrene samples. Based on a real ratio of respective molecular weight components on the GPC chromatogram, it is possible to determine M1 (wt. %) of the component having molecular weights of below $1\times10^4$, M2 (wt. %) of the component having molecular weights of $1\times10^4$–$5\times10^4$, M3 (wt. %) of the component having molecular weights of above $5\times10^4$, and M4 (wt. %) of the component having molecular weights of at least $10\times10^4$. For the content M1 (wt. %), the lower limit of the molecular weight range of the component having molecular weights of below $1\times10^4$ is set to 800 in view of noise on the chromatogram.

The THF-soluble content of toner particles can be separated by subjecting the toner particles can be separated by subjecting the toner particles to extraction with THF through the Soxhlet extractor and solidifying the THF extract.

In the first embodiment, the THF-soluble content of the toner may preferably contain the vinyl polymer unit and a component having molecular weights of at least $1\times10^4$ contains Wb (wt. %), and Wa and Wb provide a difference ($|Wa-Wb|$) therebetween satisfying the following relationship:

$$|Wa-Wb|<20.$$

By satisfying the above relationship, the difference in content of vinyl polymer unit between the lower-molecular weight component and the higher molecular weight component does not become so large, thus improving a mutual solubility therebetween. As a result, a shearing force for kneading during toner production is uniformly exerted on toner particles, thus improving a dispersibility of wax.

The vinyl polymer unit contents Wa (for the component of below $1\times10^4$) and Wb (for the component of at least $1\times10^4$) may preferably satisfy the relationship of:

$$Wa \geqq Wb,$$

more preferably $$0<Wa<50 \text{ and } 0<Wb<30,$$

further preferably $$5<Wa<30 \text{ and } 0<Wb<20.$$

In the first embodiment, as described above, the lower-molecular weight component ($<1\times10^4$) contains a relatively low crosslinking component and has lower viscosity, thus being liable to lower the wax dispersibility. When the lower-molecular weight component contains Wa (wt. %) of the vinyl polymer unit in the range of $0<Wa<50$, the resultant viscosity of the lower-molecular weight component is increased to enhance the dispersibility of wax. On the other hand, if there is no vinyl polymer unit in the higher-molecular weight component, the mutual solubility of the lower-molecular weight component with the higher-molecular weight component is liable to be lowered. When the vinyl polymer unit content Wb (wt. %) in the higher-molecular weight component is in the range of $0<Wb<30$, the mutual solubility between the lower- and higher-molecular weight components is effectively improved.

In the first embodiment, the vinyl polymer unit contents Wa and Wb is controlled to satisfy $Wa \geqq Wb$, thus increasing the content of vinyl polymer unit in the lower-molecular weight component of the toner. As a result, when the toner is prepared, a kneading shearing force is uniformly applied to effect uniform dispersion of wax in the binder resin. Accordingly, even when the resultant toner is subjected to a continuous image formation for a long period, good image formation is continuously performed without causing soiling with toner on a developing sleeve.

In the present invention, the binder resin may be in the form of a resin composition specifically described hereinafter.

In the present invention, fractionation of respective molecular weight components of a toner and a resin composition may be performed in the following manner.

Apparatus

LC-908 (mfd. by Nippon Bunseki Kogyo K.K.)

JRS-96 (repeat injector, mfd. by Nippon Bunseki Kogyo K.K.)

JAR-2 (auto-sampler, mfd. by Nippon Bunseki Kogyo K.K.)

FC-201 (fraction collector, mfd. by Gilson Co.)

Column

JAIGEL-1H to 5H (20ϕ×600 nm, columns for fractionation)

Condition

Temperature: 40° C.

Solvent: THF

Flow rate: 5 ml/min.

Detector: RI (refractive index) detector

Additives other than components for polymer or resin are removed from a sample to be subjected to fractionation.

For fractionation, an elusion time for molecular weight of $1\times10^4$ is measured in advance. Based on the elution time, fractionation into respective molecular weight components is performed.

<Composition Analysis of Binder Resin>

Each of the above-fractionated components ($<1\times10^4$ and $\geqq1\times10^4$) is hydrolyzed with 6 mol/l of NaOH and subjected to filtration. The filtrate is adjusted to assume pH=5–6, followed by extraction with ether to separate the filtrate into an ether phase (layer) and a water phase (layer). To the ether phase, methanol is added, followed by filtration to separately obtain a soluble content and an insoluble content. The (methanol) soluble content is methyl-esterified with diazomethane, followed by GC/MS (gas chromatography/mass spectrometry) to identify an acid component (polybasic carboxylic acid having three or more carboxyl groups and/or its anhydride) and a part of alcohol component (e.g., BPA-PO) having a poor water-solubility. Based on GC peak areal percentages of the identified components, respective contents thereof are obtained.

On the other hand, the weight of the (methanol) insoluble content is determined as that of vinyl polymer component (e.g., styrene-acrylic copolymer), which is then analyzed based on to H-NMR (unclear magnetic resonance) to determine a weight ratio between styrene and an acrylic monomer component.

The water phase is subjected to trimethyl-silylation with an agent therefor (e.g., bis(trimethylsilyl)acetoamide), followed by GC/MS to identify an alcohol component. Based on GC peak a real percentages, respective contents of constituting components of the alcohol component are obtained.

All the polyester-forming monomers contained in the objective component (molecular weight of below $1\times10^4$ or at least $1\times10^4$) is taken as 100 mol. %. A molar percentage W1 or W2 (mol. %) of the polybasic carboxylic acid component (e.g., trimellitic anhydride (TMA)) is calculated.

<Measurement of Weight Percentages Wa and Wb of Vinyl Polymer Unit in Toner>

0.2–0.3 g of each of the fractionated components ($<1\times10^4$ and $>1\times10^4$) is weighed and dissolved in 6 mol/l of NaOH to effect hydrolysis at 180° C. for 6 hours, followed by extraction with ether to remove the polyester-forming monomers soluble in water. To the recovered ether phase, methanol is added until a vinyl polymer component is precipitated. Based on the weight of the vinyl polymer component, a weight percentage Wa or Wb (wt. %) of the vinyl polymer component (unit) in the hybrid resin.

The THF (tetrahydrofuran)-insoluble content of the toner (particles) is measured in the following manner.

Ca. 1 g of a sample toner is accurately weighed at W3 (g), placed in a cylindrical filter paper (e.g., "No. 86R", available from Toyo Roshi K.K.) and set on a Soxhlet's extractor, followed by extraction with 200 ml of solvent THF for 10 hours. A THF-soluble content weight is determined at W4 (g) by condensing and drying the THF-extract to solid, followed by several hours of vacuum drying at 100° C. A THF-insoluble content is determined based on a THF-insoluble matter weight W5 (g) other than the binder resin (e.g., the colorant, wax or/and the magnetic material, etc.) according to the following equation:

$$\text{THF-insoluble content } (W2)=[((W3-(W5+W4))/(W3-W5)]\times100.$$

With respect to the resin composition, molar percentages w1 (mol. %) and w2 (mol. %) of the polybasic carboxylic acid component contained in the THF-soluble content may be determined similarly as in the case of those (W1 and W2) for the toner. The THF-soluble content can be obtained by subjecting the resin composition to the Soxhlet extractor with THF to extract the THF-soluble content, followed by evaporation to recover a solidified component.

On the other hand, the THF-insoluble content of the resin composition is measured in the following manner.

Ca. 1 g of a sample resin composition is accurately weighed at w3 (g), placed in a cylindrical filter (e.g., "No. 86R", available from Toyo Roshi K.K.) and set on the Soxhlet extractor, followed by extraction with 200 ml of THF for 10 hours. A THF-soluble content weight is determined at w4 (g) by condensing and drying the THF-extract to solid, followed by several hours of vacuum drying at 100° C. A THF-insoluble content of the resin composition is determined according to the following equation:

$$\text{THF-insoluble content}=[(w3-w4)/w3]\times100.$$

The toner of the present invention may be prepared by using the resin composition.

The resin composition may be used as the binder resin for the toner and in the form of a blend including those described above for the binder resin, i.e., the blend (i) (different two hybrid resins), the blend (ii) (a polyester resin and a hybrid resin), he blend (iii) (a vinyl polymer and a hybrid resin), and the blend (iv) (a vinyl polymer, a polyester resin and a hybrid resin). Among these blends, it is preferred to use the blend (i) or the blend (ii) as the resin composition.

The resin composition used in the present invention is formed with monomers containing at least a polybasic carboxylic acid having three or more carboxyl group or its anhydride (polybasic carboxylic acid component).

The resin composition contains a THF-soluble content including a lower-molecular weight component having molecular weights of below $1\times10^4$ and a higher-molecular weight component having molecular weights of at least $10^4$. The lower-molecular weight component ($<1\times10^4$) contains w1 (mol. %) of the polybasic carboxylic acid component based on (all the) polyester-forming monomers contained therein, and the higher-molecular weight component ($\geqq1\times10^4$) contains w2 (mol. %) of the polybasic carboxylic acid component based on (all the) polyester-forming monomers contained therein. The molar percentages w2 and w2 satisfy the following relationships:

$$0\leqq w1<30,$$

$$0<w2<50, \text{ and}$$

$$w2>w1.$$

In a preferred embodiment, w1 and w2 may preferably be in the following ranges:

$$1<w1<25 \text{ and } 2<w2<30,$$

particularly, $$3\leqq w1<20 \text{ and } 3<w2\leqq20.$$

By satisfying the above conditions, it is possible to obtain the above-described toner according to the present invention.

Further, w1 and w2 may further preferably provide a difference (w2−w1) therebetween in the range of $0<w2-w1<10$.

In the present invention, the resin composition contains a THF-soluble content providing a GPC (gel permeation chromatography) chromatogram, measured similarly as in the case of the toner, including 40–75 wt. %, preferably 50–75 wt. % (m1) of a component having molecular weights of below $1\times10^4$, 23–45 wt. % (m2) of a component having molecular weights of $1\times10^4$–$5\times10^4$, 2–25 wt. % (M3 ) of a component having molecular weights of above $5\times10^4$, and below 13 wt. %, preferably below 10 wt. %, (m4) of a component having molecular weights of at least $10\times10^4$, wherein the contents m1, m2, m3 and m4 satisfy the relationship of: m1≧m2>m3, preferably m1≧m2>m3>m4, in order to provide the above-mentioned toner of the present invention.

In an embodiment using the blend (i), the resin composition may preferably have a THF-insoluble content of at most 30 wt. %, more preferably 1–20 wt. %, in order to obtain the above-mentioned toner of the present invention.

In an embodiment using the blend (ii), the resin composition may preferably have a THF-insoluble content of 1–50 wt. %, more preferably 2–40 wt. %, in order to obtain the above-mentioned toner of the present invention.

The toner of the present invention may preferably have at least one temperature ($T_{HAP}$) where a heat-absorption peak on a DSC (differential scanning calorimeter) curve according to differential scanning calorimetry appears in the range of 60–120° C. Such a toner can be prepared by incorporating therein a wax providing at least one heat absorption peak on a DSC curve in a temperature range of 60–120° C.

The wax used in the present invention may preferably have a ratio (Mw/Mn) of 1.0–2.0 between a weight-average molecular weight (Mw) and a number-average molecular weight (Mn) as measured according to GPC so as to provide a sharp (narrower) molecular weight distribution.

By using the wax having such a sharp molecular weight distribution, a releasing effect thereof is quickly exhibited and it is possible to further improve an anti-low-temperature offset performance and an anti-high-temperature offset performance without impairing an anti-blocking performance.

In the first embodiment using the blend of hybrid resins, the wax is uniformly dispersed in the hybrid resins, so that the above effects are remarkably achieved.

As a result, it is possible to improve the releasability based on the use of sharp-melting wax and the dispersibility of wax based on the use of the hybrid resins, thus realizing a toner exhibiting good dispersibility and releasing effect of wax in combination.

In the second embodiment using the blend of a polyester resin and a hybrid resin, the polyester resin and the hybrid resin provide a good mutual solubility and the wax is well dispersed in the hybrid resin to be consequently dispersed uniformly in the binder resin (blend), thus remarkably exhibiting the above-mentioned effects.

Based on a combination of the releasing effect by the use of the sharp-melting wax and the improved wax dispersibility by the use of the blend of the polyester resin and the hybrid, it is possible to further efficiently achieve the releasing effect.

The molecular weight (distribution) of a wax may be measured by GPC under the following conditions:

Apparatus: "GPC-150C" (available from Waters Co.)
Column: "GMH-HT" 30 cm-binary (available from Toso K.K.)
Temperature: 135° C.
Solvent: o-dichlorobenzene containing 0.1% of ionol.
Flow rate: 1.0 ml/min.
Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

The wax may preferably have a number-average molecular weight (Mn) of 200–2000, more preferably 300–1500, further preferably 350–1000, in view of improvements in dispersibility in binder resin, anti-low-temperature offset performance, anti-high-temperature offset performance, anti-blocking performance and continuous image forming performance on a large number of sheets.

Examples of the wax may include: a low-molecular weight hydrocarbon wax consisting of carbon and hydrogen, a long-chain alkyl alcohol wax having OH group, a long-chain alkyl carboxylic acid wax having COOH group and an ester wax.

Specific examples of the low-molecular weight hydrocarbon wax may include: petroleum waxes, such as paraffin wax, microcrystalline wax and petrolactum and their derivatives; a low-molecular weight polyolefin wax, such as a low-molecular weight polyethylene; and a polymethylene wax, such as Fischer-Trosphe wax. The low-molecular weight polyolefin wax may ordinarily have an Mw/Mn ratio of above 2.0, so that the wax may preferably be purified so as to provide an Mw/Mn ratio of 1.0–2.0 and a heat-absorption peak temperature ($T_{HAP}$) of 60–120° C.

The long-chain alkyl alcohol wax may include a mixture of long-chain alcohols having 20–200 carbon atoms.

The ester wax may include a carnauba wax-purified wax, a candelilla wax-purified wax, and a wax principally comprising an ester compound between a long-chain alkyl alcohol having 15–45 carbon atoms and a long-chain alkyl carboxylic acid having 15–45 carbon atoms.

In the toner of the present invention, it is preferred to use a low-molecular weight hydrocarbon wax having a sharp molecular weight distribution in order to exhibit an effective releasing effect.

Measurement of the heat-absorption temperature (THAP) of wax and toner may be performed in the following manner by using a differential scanning calorimeter ("DSC-7", available from Perkin-Elmer Corp.) according to ASTM D3418-82.

A sample in an amount of 2–10 mg is accurately weighed. The sample is placed on an aluminum pan and subjected to measurement in a temperature range of 30–160° C. at a temperature-raising rate of 10° C./min in a normal temperature-normal humidity environment in parallel with a blank aluminum pan as a reference.

When the toner of the present invention provides at least one heat-absorption peak on its DSC curve in a temperature ($T_{HAP}$) range of 60–120° C., the wax acts on the toner from a lower temperature region in which the toner starts to be fixed, thus further improving the fixability and providing the low-temperature fixability, anti-high-temperature offset performance and anti-blocking performance in combination. If the $T_{HAP}$ is below 60° C., the anti-blocking performance is impaired, and above 120° C., the low-temperature fixability is lowered.

In the present invention, in order to stabilize the chargeability of the toner, a metal compound as a charge control agent may preferably internally or externally added to toner particles in an amount of 0.1–10 wt. parts per 100 wt. parts of the binder resin.

By the use of the change control agent, it becomes possible to effect an optimum charge control depending on a developing system used. By the use of the metal compound as the charge control agent and satisfaction of the above-mentioned relationship: W2>W1, crosslinking between the metal compound and the polybasic carboxylic acid component present in a larger amount in a higher-molecular weight region on the molecular weight distribution of the toner is promoted to broaden a non-offset temperature range. Further, the lower-molecular weight component is crosslinked moderately (although the component is less crosslinked than the higher-molecular weight component), whereby the dispersibility of wax in the toner particles is improved.

The charge control agent contained in the toner according to the present invention may include a negative or positive charge control agent.

Examples of the negative charge control agent may include: organic metal complexes and chelate compounds inclusive of monoazo metal complexes acetylacetone metal complexes, and organometal complexes of aromatic hydroxycarboxylic acids and aromatic dicarboxylic acids. Other examples may include: aromatic hydroxycarboxylic acids, aromatic mono- and poly-carboxylic acids, and their metal salts, anhydrides and esters, and phenol derivatives, such as bisphenols.

Examples of the positive charge control agents may include: nigrosine and modified products thereof with aliphatic acid metal salts, etc.; onium salts inclusive of quaternary ammonium salts, such as tributylbenzylammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; and diorganotin borates, such as dibutyltin borate, dioctyltin borate and dicyclohexyltin borate. These may be used singly or in mixture of two or more species.

The above-mentioned charge control agents may preferably be used in the form of fine particles.

In the present invention, it is preferred to use as the charge control agent an aromatic hydroxycarboxylic acid aluminum (Al) compound exhibiting a quick charging performance at an initial stage in continuous image formation and a good crosslinking effect.

It is also preferred to use a mono-azo compound iron (Fe) complex exhibiting a stable chargeability in continuous image formation for a long period.

In the present invention, a combination of the aromatic hydroxycarboxylic acid Al compound and the mono-azo compound Fe complex may preferably be used as the charge control agent in order to stably retaining the chargeability for a long period.

Preferred examples of hydroxycarboxylic acids and azo compounds used for that purpose are shown below.

(I)

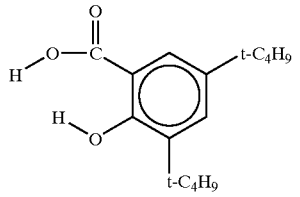

(II)

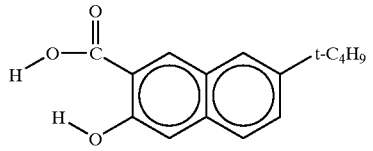

(III)

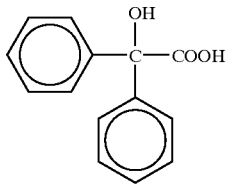

(IV)

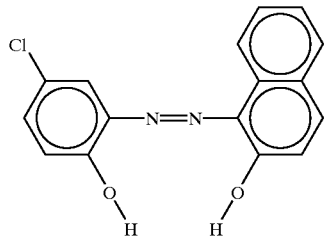

(V)

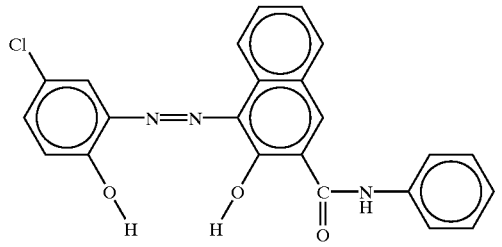

Specific examples of the metal compound prepared by using the above hydroxycarboxylic acids and azo compounds are shown below:

(VI)

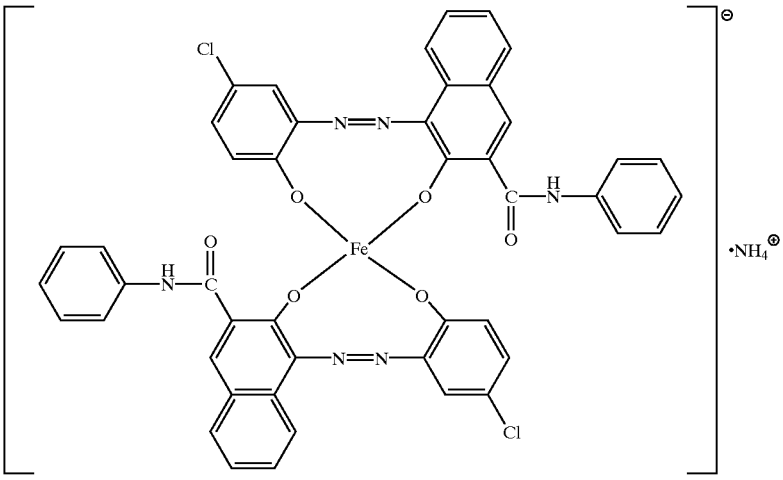

(VII)

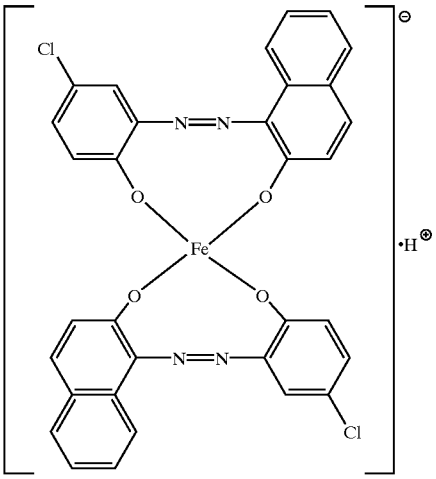

(VIII)

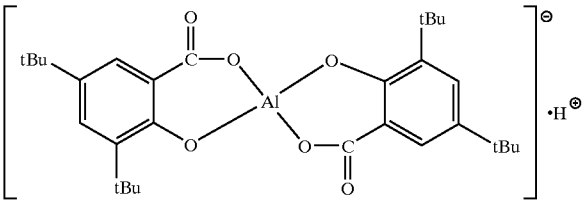

(IX)

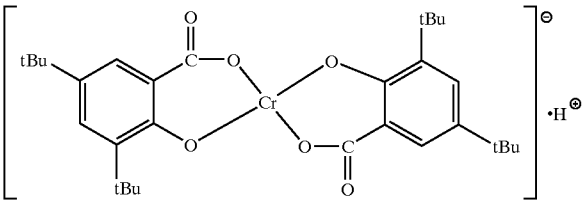

The colorant used in the present invention may include a black colorant, a yellow colorant, a magenta colorant and a cyan colorant.

Examples of the black colorant used in the present invention may include: carbon black, a magnetic material, and a colorant showing black by color-mixing of yellow/magenta/cyan colorants as shown below.

Examples of the yellow colorant may include: condensed azo compounds, isoindolinone compounds, anthraquinone compounds, azo metal complexes, methin compounds and arylamide compounds. Specific preferred examples thereof may include C.I. Pigment Yellow 12, 13, 14, 15, 17, 62, 74, 83, 93, 94, 95, 97, 109, 110, 111, 120, 127, 128, 129, 147, 168, 174, 176, 180, 181 and 191.

Examples of the magenta colorant may include: condensed azo compounds, diketopyrrolepyrrole compounds, anthraquinone compounds, quinacridone compounds, basic dye lake compounds, naphthol compounds, benzimidazole compounds, thioindigo compounds and perylene compounds. Specific preferred examples thereof may include:

C.I. Pigment Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compounds and their derivatives, anthraquinone compounds and basic dye lake compounds. Specific preferred examples thereof may include: C.I. Pigment Blue 1, 7, 15, 15:1, 15:2, 15:3, 15:4, 60, 62, and 66.

In the case where a dye and/or a pigment other than the magnetic material is used as the black colorant, the dye and/or pigment may preferably be contained in the toner in an amount of 0.1–10 wt. parts per 100 wt. parts of the binder resin. In the case of using the magnetic material, the magnetic material may preferably be used in an amount of 30–200 wt. parts per 100 wt. parts of the binder resin.

Examples of the magnetic material used in the present invention may include: metal oxides containing such as iron, cobalt, nickel, copper, magnesium, manganese, aluminum or silicon.

Among these metal oxides, those principally comprising iron oxide, such as triiron tetroxide and γ-diiron trioxide may preferably be used. In view of the control of toner charge, these metal oxides may preferably contain silicon or aluminum.

The magnetic material used in the present invention comprises magnetic particles having a specific surface area of 2–30 $m^2/g$, particularly 3–28 $m^2/g$, as measured according to the BET multi-point method wherein nitrogen gas is adsorbed onto the surface thereof. The magnetic particles may preferably have a Mohs hardness of 5–7.

The magnetic material may have an octagonal shape, a hexagonal shape, a spherical shape, an irregular shape, an acicular shape and a flake shape. Among these, it is preferred to use that in the shape with less anisotropy, such as the octagonal shape, the hexagonal shape, the spherical shape or the irregular shape in order to improve an image density. The spherical-shaped magnetic material may particularly preferably be used. Further, it is also particularly preferred to use a silica-containing magnetic material in order to increase the image density.

The magnetic material may preferably have an average particle size ($D_{AV}$) of 0.05–1.0 μm, more preferably 0.1–0.6 μm, further preferably 0.1–0.4 μm.

The average particle size ($D_{AV}$) of the magnetic material is measured in the following manner.

A sample magnetic powder is observed through a TEM (transmission-type electron microscope) and a resultant photomicrograph is enlarged at a magnification of $4\times10^4$, 250 particles having a particle size of 0.01 μm are selected at random from the enlarged portion to measure a Martin diameter (the length of a bisector of a projection area in a certain direction) for each particle. The number-basis average of the measured values of the Martin diameter for 250 particles is determined as the (number)average particle size ($D_{AV}$) of the magnetic material.

Examples of monomers for constituting the polyester resin and the polyester resin unit in the hybrid rein (polyester-forming monomers) may include the following:

Diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol derivatives represented by the following formula (A):

(A)

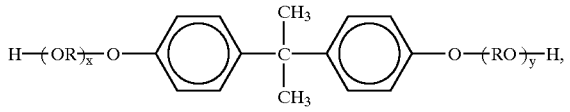

wherein R denotes an ethylene or propylene group, x and y are independently an integer of at least 1 with the proviso that the average of x+y is in the range of 2–10; diols represented by the following formula (B):

(B)

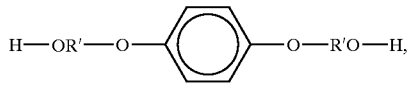

wherein R' denotes —$CH_2CH_2$—,

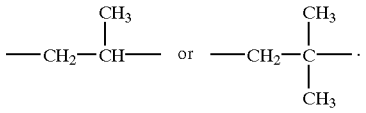

Examples of acid monomers (components) may include benzenedicarboxylic acids and their anhydrides, such as phthalic acid, isophthalic acid, terephthalic acid, and phthalic anhydride; alkyldicarboxylic acids, such as succinic acid, adipic acid, sebacic acid and azelaic acid, and their anhydrides; $C_6$–$C_{18}$ alkyl or alkenyl-substituted succinic acids, and their anhydrides; and unsaturated dicarboxylic acids, such as fumaric acid, maleic acid, citraconic acid, itaconic acid and mesaconic acid, and their anhydrides.

The binder resin of the toner of the present invention is crosslinked with a polybasic carboxylic acid component (polybasic carboxylic acid having three or more carboxyl groups or its anhydride), such as trimellitic acid, pyromellitic acid, benzophenonetetracarboxylic acid and their anhydrides. It is particularly preferred to use benzophenonetetracarboxylic acid.

The binder resin may also be crosslinked with a polyhydric alcohol, such as glycerin, pentaerythritol, sorbitol, sorbitan or novolak-type phenolic resin oxyalkylene ether.

Examples of a vinyl monomer to be used for providing the vinyl polymer unit of the hybrid resin (and the vinyl resin) may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tertbutylstyrene, p-n-hexylstyrene, p-n-octylstyrene, p-n-nonylstyrene, p-n-decylstyrene, p-n-dodecylstyrene, m-nitrostyrene, o-nitrostyrene, and p-nitrostyrene; ethylenically unsaturated monoolefins, such as ethylene, propylene, butylene, and isobutylene; unsaturated polyenes, such as butadiene and isoprene; halogenated vinyls, such as vinyl chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; and carboxy group-containing monomers including: α,β-unsaturated acids, such as acrylic acid, methacrylic acid, crotonic acid, and cinnamic acid; α,β-unsaturated acid anhydrides, such as crotonic anhydride, and cinnamic anhydride; anhydrides between such an α,β-unsaturated acid and a lower aliphatic acid; alkenylmalonic acid, alkenylglutaric acid, alkenyladipic acid, and anhydrides and monoesters of these acids.

It is also possible to use a hydroxyl group-containing monomer: inclusive of acrylic or methacrylic acid esters, such as 2-hydroxyethyl acrylate, 2-hydroxyethyl methacrylate and 2-hydroxypropyl methacrylate; 4-(1-hydroxy-1-methylbutyl)styrene, and 4-(1-hydroxy-1-methylhexyl) styrene.

As the vinyl monomer, it is also possible to use a monomer including: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; unsaturated dibasic acid half esters, such as monomethyl maleate, mono-ethyl maleate, mono-butyl maleate, mono-methyl citraconate, mono-ethyl citraconate, mono-butyl citraconate, mono-methyl itaconate, mono-methyl alkenylsuccinate, monomethyl fumarate, and mono-methyl mesaconate; unsaturated dibasic acid esters, such as dimethyl maleate and dimethyl fumarate. In the case where a proportion of the polyester-forming monomers to all the monomer components used for producing the binder resin of the toner of the present invention is calculated, the above monomers are included in the polyester-forming monomers.

In the binder resin according to the present invention, the vinyl resin or vinyl polymer unit can include a crosslinking structure obtained by using a crosslinking monomer, examples of which are enumerated hereinbelow.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylolethane triacrylate, trimethylolpropane triacrylate, tetramethylolmethane tetracrylate, oligoester acrylate, and compounds obtained by substituting methacrylate groups for the acrylate groups in the above compounds; triallyl cyanurate and triallyl trimellitate.

Such a crosslinking agent may be used in an amount of 0.01–10 wt. parts, preferably 0.03–5 wt. parts, per 100 wt. parts of the other monomers for constituting the vinyl resin or vinyl polymer unit.

In the present invention, it is preferred that the vinyl resin component and/or the polyester resin component contain a monomer component reactive with these resin component. Examples of such a monomer component constituting the polyester resin (unit) and reactive with the vinyl polymer component may include: unsaturated dicarboxylic acids, such as fumaric acid, maleic acid, citraconic acid and itaconic acid, and anhydrides thereof. Examples of such a monomer component constituting the vinyl polymer (unit) and reactive with the polyester resin component may include: carboxyl group-containing or hydroxyl group-containing monomers, and (meth)acrylate esters.

In order to obtain a binder resin mixture (blend) containing a vinyl polymer (resin) and a polyester resin (i.e., a reaction product between the vinyl polymer and polyester resin), it is preferred to effect a polymerization reaction for providing one or both of the vinyl polymer and the polyester resin in the presence of a polymer formed from a monomer mixture including a monomer component reactive with the vinyl polymer and the polyester resin as described above.

Examples of polymerization initiators for providing the vinyl resin or vinyl polymer unit according to the present invention may include: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,21-azobis(2-methylpropane); ketone peroxides, such as methyl ethyl ketone peroxide, acetylacetone peroxide, and cyclohexanon, peroxide; 2,2-bis(t-butylperoxy)-butane, t-butylhydroperoxide, cumene hydroperoxide, 1,1,3,3-tetramethylbutyl hydroperoxide, di-tert-butyl peroxide, t-butyl cumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, diisopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

The vinyl polymer unit or the vinyl polymer for constituting the binder resin used in the present invention may suitably be produced in the presence of a polyfunctional polymerization initiator or a combination thereof with a monofunctional polymerization initiator, as enumerated hereinbelow.

Specific examples of the polyfunctional polymerization initiator may include: polyfunctional polymerization initiators having at least two functional groups having a polymerization-initiating function, such as peroxide groups, per molecule, inclusive of 1,1-di-b-butylperoxy-3,3,5-trimethyl-cyclohexane, 1,3-bis-(t-butylperoxyisopropyl) benzene, 2,5-dimethyl-2,5-(t-butylperoxy)hexane, 2,5-dimethyl-2,5-di-(t-butylperoxy)hexine, tris(t-butylperoxy)-triazine, 1,1-di-t-butylperoxycyclohexane, 2,2-di-t-butylperoxybutane, 4,4-di-t-butylperoxyvaleric acid n-butyl ester, di-t-butylperoxyhexahydroterephthalate, di-t-butylperoxyazelate, di-t-butylperoxytrimethyl-adipate, 2,2-bis-(4,4-di-t-butylperoxycyclohexyl)-propane, and 2,2-t-butylperoxyoctane; and polyfunctional polymerization initiators having both a polymerization-initiating functional group, such as peroxide group, and a polymerizable unsaturation group in one molecule, such as diallylperoxydicarbonate, t-butylperoxymaleic acid, t-butylperoxyallylcarbonate, and t-butylperoxyisopropylfumarate.

Among these, particularly preferred examples may include: 1,1-di-t-butylperoxy-3,3,5-trimethyl-cyclohexane, 1,1-di-t-butylperoxycyclohexane, di-t-butylperoxyhexahydroterephthalate, di-t-butylperoxyazelate, 2,2-bis(4,4-di-t-butylperoxycyclohexyl)-propane, and t-butylperoxyallylcarbonate.

In the present invention, the binder resin or the resin composition comprises at least the hybrid resin. Herein, the hybrid resin means a resin wherein a polyester resin component and a vinyl polymer component are partially or completely chemically bonded to each other. The chemically bonded product may be called "hybrid resin component". The hybrid resin component comprises a polyester unit consisting of the polyester resin component and a vinyl polymer unit consisting of the vinyl polymer component chemically bonded to the polyester unit. In the present invention, the hybrid resin may comprise a polyester resin component and a vinyl monomer component which are not chemically bonded to each other.

More specifically, during or after production of the polyester unit from its monomers and the vinyl polymer unit from its monomers, including a carboxyl group-containing monomers, such as (meth)acrylate esters, a portion of the polyester unit and a portion of the vinyl polymer unit are chemically bonded to each other partially or entirely through esterification or/and transesterification. The polyester unit and the vinyl polymer unit may be bonded to each other via a —CO·O— bond or a —CO·O·CO— bond. The hybrid resin may preferably take a form of a graft polymer comprising the vinyl polymer unit as a trunk polymer and the polyester unit as branch polymer(s) or a block copolymer comprising a block of the polyester unit and a block of the vinyl polymer unit, preferably a graft polymer form.

The hybrid resin used for constituting the toner according to the present invention may for example be produced according to the following methods (1)–(7):

(1) The vinyl polymer and the polyester resin are separately formed and then blended. The blending may be performed by dissolving or swelling the resins in an organic solvent, followed by addition of an esterification catalyst and an alcohol, as desired, heating to effect esterification or/and transesterification, and then distilling-off of the organic solvent. Preferably, a wax may be added in the blending step.

(2) A vinyl resin is first produced, and in the presence thereof, polyester-forming monomers are added, followed by polymerization and esterification or/and transesterification. At that time, it is also possible to effect polymerization by adding optional vinyl monomer(s). In this case, an organic solvent may be used as desired. During the production, a wax may preferably be added.

(3) A polyester resin is first produced, and in the presence thereof, vinyl monomers are added, followed by polymerization and esterification or/and transesterification. At that time, it is also possible to effect polymerization by adding polyester-forming monomer(s) optionally added. Also this instance, an organic solvent may be used as desired. A wax may preferably be added in this step.

(4) A vinyl resin and a polyester resin are first produced, and in the presence of these resins, vinyl monomers and/or polyester-forming monomers are added thereto for polymerization and esterification or/and transesterification. Also this instance, an organic solvent may be used as desired. A wax may preferably be added in this step.

(5) Vinyl monomers and polyester monomers are mixed to effect addition polymerization, polycondensation and esterification or/and transesterification to provide a hybrid resin. An organic solvent may be added as desired. A wax may preferably be added in this step.

(6) The hybrid resin comprising a hybrid resin component produced by the above methods (1)–(5), and a vinyl polymer and/or a polyester resin may be dissolved or swelled in an organic solvent, followed by distilling-off of the organic solvent.

(7) To the hybrid resin comprising a hybrid resin component prepared by the above methods (1)–(5), and then vinyl monomers and/or polyester monomers are added to effect addition polymerization and esterification or/and transesterification. An organic solvent may be added as desired. A wax may preferably be added in this step.

In the above methods (1)–(4) and (6), the vinyl polymer and/or the polyester resin may respectively comprise a plurality of polymers having different molecular weights and crosslinking degrees.

In the above-described methods (1)–(7), the method (3) may be preferred because of easy molecular weight control, controllability of formation of the hybrid resin component and control of the wax dispersion state, if the wax is added at that time.

In the present invention, it is preferred to externally added inorganic fine powder, such as silica fine powder, alumina fine powder or titania fine powder, and their double oxides, in order to improve charge stability, developing characteristic and storability. For example, silica fine powder may include a dry-process silica or fumed silica obtained by vapor-oxidation of a silicone halide or alkoxide and a wet-process silica obtained from alkoxide and water glass, and it is preferred to use the dry-process silica since the dry-process silica has less silanol group at the surface of and within the silica fine powder and also less product residue, such as $Na_2O$, $SO_3^{2-}$, etc.

In the dry-process silica preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

The inorganic fine powder used in the present invention may preferably have a specific surface area as measured by nitrogen adsorption according to the BET method of at least 30 $m^2/g$, more preferably at least 50–400 $m^2/g$, so as to provide a good result. The inorganic fine powder (e.g., silica fine powder) may be added in 0.1–8 wt. parts, preferably 0.5–5 wt. parts, more preferably above 1.0 wt. part and at most 3 wt. parts, per 100 wt. parts of the toner particles.

The inorganic fine powder may preferably by treated with one or two or more species of treating agents in combination in order to provide hydrophobicity and charge control performance.

Examples of the treating agents may include: silicone varnish, silicone oil, various modified silicone oils, silane coupling agent, silane coupling agent having a functional group, organic silicone compound and organic titanium compound.

The BET specific surface area values are based on values measured by using a specific surface area meter ("Autosorb 1", available from Yuasa Ionics K.K.) through the nitrogen adsorption according to the BET multi-point method.

In order to maintain a stable storability of the toner of the present invention, the inorganic fine powder may preferably be treated with at least a silicone oil.

The toner of the present invention may further contain another external additive other than silica fine powder, as desired, such as resin particles functioning as charging aid, electroconductivity-imparting agent, flowability-imparting agent, anti-caking agent, release agent at the time of hot roller fixation, lubricant, abrasive agent, etc.

The toner according to the present invention may preferably be formed through a process wherein the above-mentioned toner component materials (including the binder resin, colorant, wax, etc.) are sufficiently blended by a blender, such as a ball mill, well kneaded by a hot kneading machine, such as a hot roller kneader or an extruder, and the kneaded product, after cooling for solidification, is mechanically pulverized and classified, to provide toner particles. It is also possible to adopt a polymerization toner production process wherein prescribed materials are mixed with a monomer (mixture) constituting the binder resin to form an emulsion or suspension liquid, followed by polymerization; a microencapsulation for providing so-called microcapsule toner particles wherein prescribed materials are incorporated into either one or both of the core material and the shell material; and a spray drying process wherein constituent materials are dispersed in a binder resin solution, and the resultant dispersion is spray-dried into toner particles. Further, the resultant toner particles may be further blended sufficiently with additive particles, as desired by a blender, such as a Henschel mixer, to provide a toner according to the present invention.

Various machines are commercially available for the above process. Several examples thereof are enumerated below together with the makers thereof. For example, the commercially available blenders may include: Henschel mixer (mfd. by Mitsui Kozan K.K.), Super Mixer (Kawata K.K.), Conical Ribbon Mixer (Ohkawara Seisakusho K.K.); Nautamixer, Turbulizer and Cyclomix (Hosokawa Micron K.K.); Spiral Pin Mixer (Taiheiyo Kiko K.K.), Lodige Mixer (Matsubo Co. Ltd.). The kneaders may include: KRC Kneader (Kurimoto Tekkosho K.K.), Buss Cokneader (Buss Co.), TEM Extruder (Toshiba Kikai K.K.), TEX Twin-Screw Kneader (Nippon Seiko K.K.), PCM Kneader (Ikegai Tekko K.K.); Three Roll Mills, Mixing Roll Mill and Kneader (Inoue Seisakusho K.K.), Kneadex (Mitsui Kozan K.K.); MS-Pressure Kneader and Kneadersuder (Moriyama Seisakusho K.K.), and Bambury Mixer (Kobe Seisakusho K.K.). As the pulverizers, Cowter Jet Mill, Micron Jet and Inomizer (Hosokawa Micron K.K.); IDS Mill and PJM Jet Pulverizer (Nippon Pneumatic Kogyo K.K.); Cross Jet Mill (Kurimoto Tekko K.K.), Ulmax (Nisso Engineering K.K.), SK Jet O. Mill (Seishin Kigyo K.K.), Krypron (Kawasaki Jukogyo K.K.), and Turbo Mill (Turbo Kogyo K.K.). As the classifiers, Classiell, Micron Classifier, and Spedic Classifier (Seishin Kigyo K.K.), Turbo Classifier (Nisshin Engineering K.K.); Micron Separator and Turboplex (ATP); Micron Separator and Turboplex (ATP); TSP Separator (Hosokawa Micron K.K.); Elbow Jet (Nittetsu Kogyo K.K.), Dispersion Separator (Nippon Pneumatic Kogyo K.K.), YM Microcut (Yasukawa Shoji K.K.). As the sieving apparatus, Ultrasonic (Koei Sangyo K.K.), Rezona Sieve and Gyrosifter (Tokuju Kosaku K.K.), Ultrasonic System (Dolton K.K.), Sonicreen (Shinto Kogyo K.K.), Turboscreener (Turbo Kogyo K.K.), Microshifter (Makino Sangyo K.K.), and circular vibrating sieves.

According to the present invention, by principally improving properties of monomers constituting the binder resin, it is possible to realize the low-temperature fixability and the anti-high-temperature offset performance in combination and provide high-quality images less lowered in developing characteristic even in continuous image formation for a long period.

EXAMPLES

Hereinbelow, the present invention will be described more specifically based on Examples, to which the present invention should not be construed to be limited.

[Series I]

Production of Binder Resins

Resin Production Example I-1

| | |
|---|---|
| BPA-PO (bisphenol A propylene oxide (2 mol) adduct) | 25 mol. % |
| BPA-EO (bisphenol A ethylene oxide (2 mol) adduct) | 25 mol. % |
| TPA (terephthalic acid) | 6 mol. % |
| TMA (trimellitic anhydride) | 24 mol. % |
| FA (fumaric acid) | 20 mol. % |

The above polyester monomers were charged together with 7 mmol of dibutyltin oxide (esterification catalyst) in an autoclave equipped with a vacuum device, a water separator, a nitrogen gas introduction device, a temperature detector and a stirring device. Then, while the system pressure was gradually lowered under a nitrogen gas atmosphere in an ordinary manner, the monomers were heated to 210° C. to effect polycondensation, thereby providing a polyester resin I-A.

Then, together with 50 wt. parts of xylene, 85 wt. parts of the above-prepared polyester resin I-A, 15 wt. parts of vinyl monomer mixture (styrene/2-ethylhexyl acrylate=84/16 by weight) and 0.3 wt. part of dibutyltin oxide (esterification catalyst) were charged in an autoclave equipped with a vacuum device, a water separator, a nitrogen gas introduction device, a temperature detector and a stirring device. The system was heated to 110° C. for dissolution and swelling under a reduced pressure and a nitrogen atmosphere in an ordinary manner. Into the system under the nitrogen atmosphere, a solution of 1 wt. part of t-butyl hydroperoxide (radical polymerization initiator) in 10 wt. parts of xylene was added dropwise in ca. 30 min. The system was held at that temperature for further 10 hours to complete the radical polymerization. The system was further heated under a reduced pressure for solvent removal to obtain a binder resin I-a comprising a hybrid resin component (comprising a vinyl polymer unit and a polyester unit). The binder resin I-a exhibited properties shown in Table 1 appearing hereinafter.

Resin Production Example I-2

| | |
|---|---|
| BPA-PO | 25 mol. % |
| PBA-EO | 25 mol. % |
| TPA | 14 mol. % |
| TMA | 18 mol. % |
| FA | 18 mol. % |

The polyester resin I-B was prepared in the same manner as in Resin Production Example I-1 except that the composition of the polyester monomers was changed to the above-indicated composition.

Then, a binder resin I-b comprising a hybrid resin component was prepared in the same manner as in Example I-1 except that 90 wt. parts of the polymer resin I-B and 10 wt. parts of the vinyl monomer mixture were used.

The thus-prepared binder resin I-b exhibited properties shown in Table 1.

Resin Production Example I-3

| | |
|---|---|
| BPA-PO | 31 mol. % |
| PBA-EO | 19 mol. % |
| TPA | 19 mol. % |
| TMA | 6 mol. % |
| FA | 25 mol. % |

The polyester resin I-C was prepared in the same manner as in Resin Production Example I-1 except that the composition of the polyester monomers was changed to the above-indicated composition.

Then, a binder resin I-c comprising a hybrid resin component was prepared in the same manner as in Example I-1 except that 60 wt. parts of the polymer resin I-C and 40 wt. parts of the vinyl monomer mixture were used.

The thus-prepared binder resin I-c exhibited properties shown in Table 1.

Resin Production Example I-4

| | |
|---|---|
| BPA-PO | 25 mol. % |
| PBA-EO | 25 mol. % |
| TPA | 15 mol. % |
| FA | 35 mol. % |

The polyester resin I-D was prepared in the same manner as in Resin Production Example I-1 except that the composition of the polyester monomers was changed to the above-indicated composition.

Then, a binder resin I-d comprising a hybrid resin component was prepared in the same manner as in Example I-1 except that 50 wt. parts of the polymer resin I-D and 50 wt. parts of the vinyl monomer mixture were used.

The thus-prepared binder resin I-d exhibited properties shown in Table 1.

Resin Production Example I-5

| | |
|---|---|
| BPA-PO | 15 mol. % |
| PBA-EO | 35 mol. % |
| TPA | 15 mol. % |
| TMA | 0.1 mol. % |
| FA | 34.9 mol. % |

The polyester resin I-E was prepared in the same manner as in Resin Production Example I-1 except that the composition of the polyester monomers was changed to the above-indicated composition.

Then, a binder resin I-e comprising a hybrid resin component was prepared in the same manner as in Example I-1 except that 95 wt. parts of the polymer resin I-E and 5 wt. parts of the vinyl monomer mixture were used.

The thus-prepared binder resin I-e exhibited properties shown in Table 1.

Resin Production Example I-6

| | |
|---|---|
| BPA-PO | 23 mol. % |
| PBA-EO | 27 mol. % |
| TPA | 4 mol. % |
| TMA | 36 mol. % |
| FA | 10 mol. % |

The polyester resin I-F was prepared in the same manner as in Resin Production Example I-1 except that the composition of the polyester monomers was changed to the above-indicated composition.

Then, a binder resin I-f comprising a hybrid resin component was prepared in the same manner as in Example I-1 except that 10 wt. parts of the polymer resin I-F and 90 wt. parts of the vinyl monomer mixture were used.

The thus-prepared binder resin I-f exhibited properties shown in Table 1.

Resin Production Example I-7

| | |
|---|---|
| BPA-PO | 28 mol. % |
| PBA-EO | 22 mol. % |
| TPA | 5 mol. % |
| TMA | 30 mol. % |
| FA | 15 mol. % |

The polyester resin I-G was prepared in the same manner as in Resin Production Example I-1 except that the composition of the polyester monomers was changed to the above-indicated composition.

Then, a binder resin I-g comprising a hybrid resin component was prepared in the same manner as in Example I-1 except that 95 wt. parts of the polymer resin I-G and 5 wt. parts of the vinyl monomer mixture were used.

The thus-prepared binder resin I-g exhibited properties shown in Table 1.

Resin Production Example I-8

| | |
|---|---|
| BPA-PO | 21 mol. % |
| PBA-EO | 29 mol. % |
| TPA | 3 mol. % |
| TMA | 40 mol. % |
| FA | 7 mol. % |

The polyester resin I-H was prepared in the same manner as in Resin Production Example I-1 except that the composition of the polyester monomers was changed to the above-indicated composition.

Then, a binder resin I-h comprising a hybrid resin component was prepared in the same manner as in Example I-1 except that 95 wt. parts of the polymer resin I-H and 5 wt. parts of the vinyl monomer mixture were used.

The thus-prepared binder resin I-h exhibited properties shown in Table 1.

Example I-1

| | |
|---|---|
| Binder resin I-a | 70 wt. parts |
| Binder resin I-c | 30 wt. parts |
| Magnetic iron oxide (spherical, Dav (average particle size) = 0.2 $\mu$m) | 100 wt. parts |
| 3,5-di-t-butylsalicylic acid Al compound (formula VIII) | 1 wt. parts |
| Mono-azo iron complex (formula VI) | 1 wt. parts |
| Low-molecular weight polyethylene (Wax) ($T_{HAP}$ (heat-absorption peak temperature on DSC curve) = 106.7° C., Mw/Mn = 1.08) | 2 wt. parts |

The above ingredients were preliminarily blended by a Henschel mixer and then melt-kneaded through a twin-screw kneading extruder ("PCM-30", mfd. by Ikegai Tekkosho K.K.) set at 130° C.

The thus-kneaded product was cooled, coarsely crushed by a cutter mill and finely pulverized by a pulverizer using a jet air stream, followed by classification by a multi-division classifier utilizing the Coanda effect to form magnetic toner particles having a weight-average particle size (D4) of 7.0 $\mu$m. To 100 wt. parts of the magnetic toner particles, 1.2 wt. parts of hydrophobic silica fine powder (successively hydrophobized with 10 wt. % based on starting silica fine powder) of hexamethyldisilazane and 10 wt. % of dimethylsilicone oil (based on the silica fine powder treated with hexamethyldisilazane) was externally blended by a mixer to prepare a toner I-1.

The composition and properties of the thus obtained toner I-1 are shown in Tables 2 and 3, respectively appearing hereinafter.

Example I-2

| | |
|---|---|
| Binder Resin I-b | 30 wt. parts |
| Binder resin I-d | 70 wt. parts |
| Magnetic iron oxide (spherical, $D_{AV}$ = 0.20 $\mu$m) | 100 wt. parts |

-continued

| | |
|---|---|
| 3,5-di-t-butylsalicylic acid Al compound (formula VIII) | 3 wt. parts |
| Low-molecular weight polyethylene ($T_{HAP}$ = 106.7° C., Mw/Mn = 1.08) | 2 wt. parts |

A toner I-2 was prepared in the same manner as in Example I-1 except for using the above ingredients in place of those used in Example I-1.

The composition and properties of the thus-prepared toner I-2 are shown in Tables 2 and 3, respectively.

Example I-3

| | |
|---|---|
| Binder resin I-b | 60 wt. parts |
| Binder resin I-c | 40 wt. parts |
| Magnetic iron oxide (spherical, $D_{AV}$ = 0.20 $\mu$m) | 100 wt. parts |
| Mono-azo iron complex (formula VI) | 2 wt. parts |
| Higher alcohol ($T_{HAP}$ = 99° C., Mw/Mn = 1.84) | 2 wt. parts |

A toner I-3 was prepared in the same manner as in Example I-1 except for using the above ingredients in place of those used in Example I-1.

The composition and properties of the thus-prepared toner I-3 are shown in Tables 2 and 3, respectively.

Example I-4

| | |
|---|---|
| Binder resin I-e | 50 wt. parts |
| Binder resin I-f | 50 wt. parts |
| Magnetic iron oxide (spherical, $D_{AV}$ = 0.20 $\mu$m) | 100 wt. parts |
| 3,5-di-t-butylsalicylic acid Al compound (formula VIII) | 3 wt. parts |
| Low-molecular weight polypropylene ($T_{HAP}$ = 145° C., Mw/Mn = 8.8) | 2 wt. parts |

A toner I-4 was prepared in the same manner as in Example I-1 except for using the above ingredients in place of those used in Example I-1.

The composition and properties of the thus-prepared toner I-4 are shown in Tables 2 and 3, respectively.

Reference Example I-5

| | |
|---|---|
| Binder resin I-d | 40 wt. parts |
| Binder resin I-h | 60 wt. parts |
| Carbon black | 10 wt. parts |
| Mono-azo chromium complex (formula VII) | 2 wt. parts |
| Low-molecular weight polypropylene ($T_{HAP}$ = 145° C., Mw/Mn = 8.8) | 4 wt. parts |

A toner I-5 was prepared in the same manner as in Example I-1 except for using the above ingredients in place of those used in Example I-1.

The composition and properties of the thus-prepared toner I-5 are shown in Tables 2 and 3, respectively.

Reference Example I-6

| | |
|---|---|
| Binder resin I-a | 5 wt. parts |
| Binder resin I-d | 95 wt. parts |
| Carbon black | 10 wt. parts |
| 3,5-di-t-butylsalicylic acid Al compound (formula VIII) | 3 wt. parts |
| Low-molecular weight polypropylene ($T_{HAP}$ = 145° C., Mw/Mn = 8.8) | 4 wt. parts |

A toner I-6 was prepared in the same manner as in Example I-1 except for using the above ingredients in place of those used in Example I-1.

The composition and properties of the thus-prepared toner I-6 are shown in Tables 2 and 3, respectively.

Reference Example I-7

| | |
|---|---|
| Binder resin I-e | 20 wt. parts |
| Binder resin I-h | 80 wt. parts |
| Carbon black | 10 wt. parts |
| Mono-azo chromium complex (formula VII) | 2 wt. parts |
| Low-molecular weight polypropylene ($T_{HAP}$ = 145° C., Mw/Mn = 8.8) | 4 wt. parts |

A toner I-7 was prepared in the same manner as in Example I-1 except for using the above ingredients in place of those used in Example I-1.

The composition and properties of the thus-prepared toner I-7 are shown in Tables 2 and 3, respectively.

Comparative Example I-1

| | |
|---|---|
| Binder resin I-c | 100 wt. parts |
| Magnetic iron oxide (spherical, $D_{AV}$ = 0.20 μm) | 100 wt. parts |
| 3,5-di-t-butylsalicylic acid Cr compound (formula IX) | 4 wt. parts |
| Low-molecular weight polyethylene ($T_{HAP}$ = 126° C., Mw/Mn = 1.5) | 2 wt. parts |

A toner I-8 was prepared in the same manner as in Example I-1 except for using the above ingredients in place of those used in Example I-1.

The composition and properties of the thus-prepared toner I-8 are shown in Tables 2 and 3, respectively.

Comparative Example I-2

| | |
|---|---|
| Binder resin I-d | 100 " |
| Carbon black | 10 " |
| 3,5-di-t-butylsalicylic acid Cr compound (formula IX) | 6 " |
| Low-molecular weight polypropylene ($T_{HAP}$ = 145° C., Mw/Mn = 8.8) | 4 " |

A toner I-9 was prepared in the same manner as in Example I-1 except for using the above ingredients in place of those used in Example I-1.

The composition and properties of the thus-prepared toner I-9 are shown in Tables 2 and 3, respectively.

Comparative Example I-3

| | |
|---|---|
| Binder resin I-g | 50 wt. parts |
| Binder resin I-f | 50 wt. parts |
| Carbon black | 10 wt. parts |
| Mono-azo chromium complex (formula VII) | 1 wt. parts |
| Low-molecular weight polypropylene ($T_{HAP}$ = 145° C., Mw/Mn = 8.8) | 4 wt. parts |

A toner I-10 was prepared in the same manner as in Example I-1 except for using the above ingredients in place of those used in Example I-1.

The composition and properties of the thus-prepared toner I-10 are shown in Tables 2 and 3, respectively.

With respect to the binder resins used in the above Examples I-1 to I-7 and Comparative Examples I-1 to I-3, respective two binder resins (excepet for a binder resin uesd alone for Comparative Examples I-1 and I-2, respectively) were dry-blended each other to prepare corresponding resin compositions I-1 to I-10, respectively, as shown in Table 4 appearing hereinafter.

The properties of the resin compositions I-1 to I-10 are also shown in Table 4.

The above-prepared toners I-1 to I-10 were evaluated with respect to the following items, respectively.

Low-temperature Fixability

Each of the toners I-1 to I-10 was subjected to (yet-unfixed) image formation by using an image forming apparatus ("Laser Jet 8100", mfd. by Hewlett-Packard Co.) rom which a fixing device was removed to form a yet-unfixed solid black image on paper at a toner coverage (coating rate) of 0.6 mg/cm$^2$.

The removed fixing device was provided with an external drive and a temperature control unit. The above-formed yet-unfixed solid black image was fixed by using the external fixing device under conditions including a fixation temperature of 160° C. and a process speed of 145 mm/sec.

The thus-formed fixed toner image was rubbed with a paper ("Dasper", mfd. by Ozu Sangyo K.K.) at a load of 50 g/cm$^2$, whereby an image density lowering percentage (IDLP) after the rubbing was measured relative to the image density before the rubbing.

Anti-hot Offset Performance

Similarly as in the evaluation for the low-temperature fixability, a yet-unfixed solid black image (toner coverage= 0.6 mg/cm$^2$) was fixed by using the external fixing device at a fixation temperature of 240° C. and a process speed of 145 mm/sec. The fixed toner image was observed as to whether hot offset (HO) occurred or not.

(Evaluation Standard)

A: Not occurred at all.

B: Slight offset occurred but was at a practically acceptable level.

C: Offset readily recognizable with eyes occurred but was at a practically acceptable level.

D: Offset occurred and was at a practically unacceptable level.

E: Remarkable offset occurred.

Wax Dispersibility

With respect of each of the toners I-1 to I-10, fine powder fraction and medium powder fraction (average particle size of 7.0 μm) of toner particles classified in the classification step for toner production were subjected to measurement of a wax content (F) in fine powder fraction and a wax content (M) in medium powder fraction based on amount of heat for a peak attributable to wax by using a differential scanning calorimeter ("DSC-7", mfd. by Perkin-Elmer Corp.) to obtain a ratio (F/M) of the wax content (F) in fine powder fraction to the wax content (M) in medium powder fraction.

Developing Performance

Each of the toners I-1 to I-10 was subjected to image formation on 20,000 sheets (durability test) of a solid black image (printing areal percentage=4%) under an environment of 32.5° C. and 85% RH by using an image forming apparatus ("Laser Jet 8100", mfd. by Hewlett-Packard Co.) while supplying A4-size paper in a longitudinal direction at an image forming speed of 32 sheets/min.

With respect to the thus-formed solid black image on A4-size paper, an image density was measured at an initial stage and after the durability test (on 20,000 sheets) by using a Macbeth densitometer (available from Macbeth Co.) to evaluate the developing performance.

Soiling on Separation Claw (of Fixing Device)

After the above-mentioned durability test (on 20,000 sheets), a state of a separation claw of a fixing device was observed as to whether the separation claw was soiled by toner particles.

(Evaluation Standard)

A: No soiling on separation claw occurred and a resultant image was not affected.

B: Separation claw was soiled by toner particles but the toner particles were readily removed with fingers and did not affect a resultant image.

C: Separation claw was soiled by toner particles but the toner particles were removed by rubbing intensity the separation claw with fingers and did not affect a resultant image.

D: Separation claw was soiled such that attached toner particles were not removed unless intense rubbing with fingers was effected, and clear white streaks were observed on the solid black image.

E: Separation claw was solid by toner particles, which were not removed by intense rubbing with fingers, and clear white streaks were observed on the solid black image.

Soiling on Developing Sleeve

After the above-mentioned evaluation of the developing performance, toner particles remaining on the developing sleeve were cleaned by air blow, followed by observation with eyes as to whether soiling on the developing sleeve occurred or not.

The results of evaluation for the above items are shown in Table 5 appearing hereinafter.

TABLE 1

| Binder resin No. | Polyester monomers *1 (mol. %) | | | | | Vinyl monomers *2 (wt. %) | | Proportion of vinyl monomers (%) | THF-insoluble content (wt. %) | Molecular weight distribution (%) | | |
|---|---|---|---|---|---|---|---|---|---|---|---|---|
| | BPA-PO | BPA-EO | TPA | TMA | FA | Styrene | EHA | | | $<1 \times 10^4$ | $1 \times 10^4$–$5 \times 10^4$ | $5 \times 10^4$< |
| I-a | 25 | 25 | 6 | 24 | 20 | 84 | 16 | 15 | 24.6 | 43.7 | 37.6 | 18.7 |
| I-b | 25 | 25 | 14 | 18 | 18 | 84 | 16 | 10 | 4.3 | 39.9 | 38.6 | 21.5 |
| I-c | 31 | 19 | 19 | 6 | 25 | 84 | 16 | 40 | 0 | 60.1 | 33.7 | 6.2 |
| I-d | 25 | 25 | 15 | 0 | 35 | 84 | 16 | 50 | 0 | 61.0 | 36.6 | 2.4 |
| I-e | 15 | 35 | 15 | 0.1 | 34.9 | 84 | 16 | 5 | 0 | 63.8 | 33.9 | 2.3 |
| I-f | 23 | 27 | 4 | 36 | 10 | 84 | 16 | 90 | 23.5 | 40.0 | 36.3 | 23.7 |
| I-g | 28 | 22 | 5 | 30 | 15 | 84 | 16 | 5 | 5.8 | 48.6 | 36.6 | 14.8 |
| I-h | 21 | 29 | 3 | 40 | 7 | 84 | 16 | 5 | 28.7 | 58.4 | 32.6 | 9.0 |

*1: BPA-PO: Bisphenol A PO-adduct
BPA-EO: Bisphenol A EO-adduct
TPA: Terephtharic acid
TMA: Trimellitic anhydride
FA: Fumaric acid
*2: EHA: 2-ethylhexyl acrylate

TABLE 2

| Ex. No. | Toner No. | Resin 1 No. | Resin 1 wt. parts | Resin 2 No. | Resin 2 wt. parts | Colorant Species | Colorant wt. parts | Metal compound 1* Species | Metal compound 1* wt. parts | Metal compound 2 Species | Metal compound 2 wt. parts | Wax Species | Wax wt. parts |
|---|---|---|---|---|---|---|---|---|---|---|---|---|---|
| Ex. I-1 | I-1 | I-a | 70 | I-c | 30 | Magnetic iron oxide | 100 | Al compound | 1 | Monoazo Fe compound | 1 | Polyethylene | 2 |
| Ex. I-2 | I-2 | I-b | 30 | I-d | 70 | Magnetic iron oxide | 100 | Al compound | 3 | — | — | " | 2 |
| Ex. I-3 | I-3 | I-b | 60 | I-c | 40 | Magnetic iron oxide | 100 | — | — | Monoazo Fe compound | 2 | Higher alcohol | 2 |
| Ex. I-4 | I-4 | I-e | 50 | I-f | 50 | Magnetic iron oxide | 100 | Al compound | 2 | — | — | Polypropylene | 4 |
| Ex. I-5 | I-5 | I-d | 40 | I-h | 60 | Carbon black | 10 | — | — | Monoazo Cr compound | 2 | " | 4 |

TABLE 2-continued

| | Toner | Resin 1 | | Resin 2 | | Colorant | | Metal compound 1* | | Metal compound 2 | | Wax | |
|---|---|---|---|---|---|---|---|---|---|---|---|---|---|
| Ex. No. | No. | No. | wt. parts | No. | wt. parts | Species | wt. parts | Species | wt. parts | Species | wt. parts | Species | wt. parts |
| Ex. I-6 | I-6 | I-a | 5 | I-d | 95 | Carbon black | 10 | Al compound | 3 | — | — | " | 4 |
| Ex. I-7 | I-7 | I-e | 20 | I-h | 80 | Carbon black | 10 | — | — | Monoazo Cr compound | 2 | " | 4 |
| Comp. Ex. I-1 | I-8 | I-c | 100 | — | — | Magnetic iron oxide | 100 | Cr compound | 4 | — | — | Polyethylene | 2 |
| Comp. Ex. I-2 | I-9 | I-d | 100 | — | — | Carbon black | 10 | Cr compound | 6 | — | — | Polypropylene | 4 |
| Comp. Ex. I-3 | I-10 | I-g | 50 | I-f | 50 | Carbon black | 10 | — | — | Monoazo Cr compound | 1 | " | 4 |

*Al compound: 3,5-di-t-butylsalicylic acid Al compound
Cr compound: 3,5-d-t-butylsalicylic acid Cr compound

TABLE 3

| | | | | Molecular weight distribution of toner (%) | | | | | | | | | |
|---|---|---|---|---|---|---|---|---|---|---|---|---|---|
| Ex. No. | Toner No. | $T_{HPA}$ for toner (° C.) | THFins. (wt. %) | M1 (<1 × $10^4$) | M2 (1 × $10^4$–5 × $10^4$) | M3 (5 × $10^4$<) | M4 (10 × $10^4$≦) | W1 (mol. %) | W2 (mol. %) | Wa (wt. %) | Wb (wt. %) | W2 − W1 | \|Wa − Wb\| |
| Ex. I-1 | I-1 | 104.4 | 13.9 | 49.6 | 37.4 | 13.0 | 9.1 | 14.2 | 15.4 | 24.3 | 20.8 | 2.2 | 3.5 |
| Ex. I-2 | I-2 | 104.4 | 1.1 | 54.7 | 37.2 | 8.1 | 4.2 | 3.5 | 6.4 | 41.2 | 25.4 | 2.9 | 15.8 |
| Ex. I-3 | I-3 | 102.9 | 2.1 | 49.0 | 37.6 | 13.4 | 8.8 | 9.9 | 12.3 | 25.0 | 19.2 | 2.4 | 5.8 |
| Ex. I-4 | I-4 | 139.7 | 9.7 | 51.9 | 35.1 | 13.0 | 7.6 | 1.5 | 2.3 | 37.8 | 58.0 | 0.8 | 20.2 |
| Ex. I-5 | I-5 | 139.7 | 13.2 | 59.4 | 34.2 | 6.2 | 1.7 | 22.4 | 23.4 | 23.5 | 22.3 | 1.0 | 1.2 |
| Ex. I-6 | I-6 | 139.7 | 0.8 | 60.1 | 36.7 | 3.2 | 0.1 | 0.7 | 1.4 | 48.7 | 47.5 | 0.7 | 1.2 |
| Ex. I-7 | I-7 | 139.7 | 18.7 | 59.4 | 32.9 | 7.7 | 3.2 | 29.9 | 31.2 | 5.0 | 5.0 | 1.3 | 0 |
| Comp. Ex. I-1 | I-8 | 125.4 | 0 | 57.4 | 34.5 | 8.0 | 3.3 | 3.6 | 3.6 | 40.0 | 40.0 | 0.0 | 0 |
| Comp. Ex. I-2 | I-9 | 139.7 | 0 | 56.2 | 37.8 | 6.0 | 2.1 | 0 | 0 | 50.0 | 50.0 | 0.0 | 0 |
| Comp. Ex. I-3 | I-10 | 139.7 | 12.1 | 40.0 | 41.3 | 18.7 | 12.9 | 17.3 | 15.1 | 43.4 | 50.8 | −2.2 | 7.4 |

*THFins.: THF insoluble content in the toner.

TABLE 4

(Resin component properties)

| | Resin composition | Resin 1 | | Resin 2 | | Molecular weight distribution (%) | | | | |
|---|---|---|---|---|---|---|---|---|---|---|
| | | | | | | <1 × $10^4$ | 1 × $10^4$–5 × $10^4$ | 5 × $10^4$< | 10 × $10^4$≦ | THFins. |
| Ex. No. | No. | species | wt. parts | species | wt. parts | m1 | m2 | m3 | m4 | (wt. %) |
| Ex. I-1 | I-1 | I-a | 70 | I-c | 30 | 48.62 | 36.43 | 14.95 | 10.5 | 18.51 |
| Ex. I-2 | I-2 | I-b | 30 | I-d | 70 | 54.67 | 37.2 | 8.13 | 4.5 | 1.29 |
| Ex. I-3 | I-3 | I-b | 60 | I-c | 40 | 47.98 | 36.64 | 15.38 | 11.3 | 2.58 |
| Ex. I-4 | I-4 | I-e | 50 | I-f | 50 | 51.9 | 35.1 | 13 | 8.7 | 11.75 |
| Ex. I-5 | I-5 | I-d | 40 | I-h | 60 | 59.44 | 34.2 | 6.36 | 2.8 | 17.22 |
| Ex. I-6 | I-6 | I-a | 5 | I-d | 95 | 60.14 | 36.65 | 3.22 | 0 | 1.23 |
| Ex. I-7 | I-7 | I-e | 20 | I-h | 80 | 59.48 | 32.86 | 7.66 | 3.2 | 22.96 |
| Comp. Ex. I-1 | I-8 | I-c | 100 | — | — | 60.1 | 33.7 | 6.2 | 1.1 | 0 |
| Comp. Ex. I-2 | I-9 | I-d | 100 | — | — | 61 | 36.6 | 2.4 | 0 | 0 |
| Comp. Ex. I-3 | I-10 | I-g | 50 | I-f | 50 | 44.3 | 36.45 | 19.25 | 16.5 | 14.65 |

TABLE 5

| | | F/M | IDLP at | HO at | Image density | | Separation | Sleeve |
|---|---|---|---|---|---|---|---|---|
| Ex. No. | Toner No. | (for wax) | 160° C. | 240° C. | Initial | After 20,000 sheets | claw soiling | soiling |
| Ex. I-1 | I-1 | 1.02 | 1.2 | A | 1.49 | 1.50 | A | None |
| Ex. I-2 | I-2 | 1.07 | 1.5 | B | 1.51 | 1.45 | A | " |
| Ex. I-3 | I-3 | 1.09 | 1.4 | A | 1.44 | 1.52 | A | " |

TABLE 5-continued

| Ex. No. | Toner No. | F/M (for wax) | IDLP at 160° C. | HO at 240° C. | Image density Initial | Image density After 20,000 sheets | Separation claw soiling | Sleeve soiling |
|---|---|---|---|---|---|---|---|---|
| Ex. I-4 | I-4 | 1.40 | 3.0 | A | 1.50 | 1.46 | B | " |
| Ex. I-5 | I-5 | 1.26 | 6.6 | A | 1.48 | 1.45 | B | " |
| Ex. I-6 | I-6 | 1.28 | 8.1 | C | 1.48 | 1.40 | C | " |
| Ex. I-7 | I-7 | 1.35 | 12.3 | A | 1.47 | 1.51 | C | " |
| Comp. Ex. I-1 | I-8 | 1.00 | 9.5 | E | 1.40 | 0.91 | D | Occurred |
| Comp. Ex. I-2 | I-9 | 1.54 | 6.2 | D | 1.40 | 1.12 | E | " |
| Comp. Ex. I-3 | I-10 | 1.60 | 23.7 | B | 1.39 | 1.48 | A | " |

[Series II]
Production of Binder Resins

Resin Production Example II-1

A binder resin II-a (polyester resin) was prepared through (dehydro)polycondensation of polyester monomers shown in Table 6 appearing hereinafter.

The binder resin II-a exhibited properties also shown in Table 6.

Resin Production Example II-2

A binder resin II-b (styrene-acrylic copolymer) was prepared through addition polymerization of vinyl monomers shown in Table 6 appearing hereinafter.

The binder resin II-b exhibited properties also shown in Table 6.

Resin Production Example II-3

| | |
|---|---|
| BPA-PO (bisphenol A propylene oxide (2 mol) adduct) | 35 mol. % |
| BPA-EO (bisphenol A ethylene oxide (2 mol) adduct) | 15 mol. % |
| TPA (terephthalic acid) | 11 mol. % |
| TMA (trimellitic anhydride) | 22 mol. % |
| FA (fumaric acid) | 17 mol. % |

The above polyester monomers were charged together with 7 mmol of dibutyltin oxide (esterification catalyst) in an autoclave equipped with a vacuum device, a water separator, a nitrogen gas introduction device, a temperature detector and a stirring device. Then, while the system pressure was gradually lowered under a nitrogen gas atmosphere in an ordinary manner, the monomers were heated to 210° C. to effect polycondensation, thereby providing a polyester resin II-A.

Then, together with 50 wt. parts of xylene, 85 wt. parts of the above-prepared polyester resin II-A, 15 wt. parts of vinyl monomer mixture (styrene/2-ethylhexyl acrylate=84/16 by weight) and 0.3 wt. part of dibutyltin oxide (esterification catalyst) were charged in an autoclave equipped with a vacuum device, a water separator, a nitrogen gas introduction device, a temperature detector and a stirring device. The system was heated to 110° C. for dissolution and swelling under a reduced pressure and a nitrogen atmosphere in an ordinary manner. Into the system under the nitrogen atmosphere, a solution of 1 wt. part of t-butyl hydroperoxide (radical polymerization initiator) in 10 wt. parts of xylene was added dropwise in ca. 30 min. The system was held at that temperature for further 10 hours to complete the radical polymerization. The system was further heated under a reduced pressure for solvent removal to obtain a binder resin II-c comprising a hybrid resin component (comprising a vinyl polymer unit and a polyester unit). The binder resin II-c exhibited properties shown in Table 5.

Resin Production Example II-4

| | |
|---|---|
| BPA-PO | 35 mol. % |
| PBA-EO | 15 mol. % |
| TPA | 30 mol. % |
| TMA | 5 mol. % |
| SA (succinic acid derivative) | 15 mol % |

The polyester resin II-B was prepared in the same manner as in Resin Prpduction Example II-1 except that the composition of the polyester monomers was changed to the above-indicated composition.

Then, a binder resin II-d comprising a hybrid resin component was prepared in the same manner as in Example II-3 except that 75 wt. parts of the polymer resin II-B and 25 wt. parts of the vinyl monomer mixture were used.

The thus-prepared binder resin II-d exhibited properties shown in Table 6.

Resin Production Example II-5

| | |
|---|---|
| BPA-PO | 35 mol. % |
| PBA-EO | 15 mol. % |
| TMA | 15 mol. % |
| FA | 35 mol. % |

The polyester resin II-C was prepared in the same manner as in Resin Production Example UI-1 except that the composition of the polyester monomers was changed to the above-indicated composition.

Then, a binder resin II-e comprising a hybrid resin component was prepared in the same manner as in Example II-3 except that 95 wt. parts of the polymer resin II-C and 5 wt. parts of the vinyl monomer mixture were used.

The thus-prepared binder resin II-e exhibited properties shown in Table 6.

Resin Production Example II-6

| | |
|---|---|
| BPA-PO | 15 mol. % |
| PBA-EO | 35 mol. % |

-continued

| | |
|---|---|
| TPA | 31 mol. % |
| FA | 19 mol. % |

The polyester resin II-D was prepared in the same manner as in Resin Production Example II-1 except that the composition of the polyester monomers was changed to the above-indicated composition.

Then, a binder resin II-f comprising a hybrid resin component was prepared in the same manner as in Example II-3 except that 90 wt. parts of the polymer resin II-D and 10 wt. parts of the vinyl monomer mixture were used.

The thus-prepared binder resin II-f exhibited properties shown in Table 6.

Resin Production Example II-7

| | |
|---|---|
| BPA-PO | 15 mol. % |
| PBA-EO | 35 mol. % |
| TMA | 41 mol. % |
| FA | 9 mol. % |

The polyester resin II-E was prepared in the same manner as in Resin Production Example II-1 except that the composition of the polyester monomers was changed to the above-indicated composition.

Then, a binder resin II-g comprising a hybrid resin component was prepared in the same manner as in Example II-3 except that 90 wt. parts of the polymer resin II-E and 10 wt. parts of the vinyl monomer mixture were used.

The thus-prepared binder resin II-g exhibited properties shown in Table 6.

Example II-1

| | |
|---|---|
| Binder resin II-a | 30 wt. parts |
| Binder resin II-c | 70 wt. parts |
| Magnetic iron oxide (spherical, Dav = 0.2 $\mu$m) | 100 wt. parts |
| 3,5-di-t-butylsalicylic acid Al compound (formula VIII) | 2 wt. parts |
| Mono-azo iron complex (formula VI) | 1 wt. parts |
| Low-molecular weight polyethylene (Wax) ($T_{HAP}$ = 106.7° C., Mw/Mn = 1.2) | 2 wt. parts |

The above ingredients were preliminarily blended by a Henschel mixer and then melt-kneaded through a twin-screw kneading extruder ("PCM-30", mfd. by Ikegai Tekkosho K.K.) set at 130° C.

The thus-kneaded product was cooled, coarsely crushed by a cutter mill and finely pulverized by a pulverizer using a jet air stream, followed by classification by a multi-division classifier utilizing the Coanda effect to form magnetic toner particles having a weight-average particle size (D4) of 7.0 $\mu$m. To 100 wt. parts of the magnetic toner particles, 1.2 wt. parts of hydrophobic silica fine powder (successively hydrophobized with 10 wt. % based on starting silica fine powder) of hexamethyldisilazane and 10 wt. % of dimethylsilicone oil (based on the silica fine powder treated with hexamethyldisilazane) was externally blended by a mixer to prepare a toner II-1.

The composition and properties of the thus obtained toner II-1 are shown in Tables 7 and 8, respectively appearing hereinafter.

Example II-2

| | |
|---|---|
| Binder resin II-a | 30 wt. parts |
| Binder resin II-e | 70 wt. parts |
| Magnetic iron oxide (spherical, $D_{AV}$ = 0.20 $\mu$m) | 100 wt. parts |
| 3,5-di-t-butylsalicylic acid Al compound (formula VIII) | 1 wt. parts |
| Low-molecular weight polyethylene ($T_{HAP}$ = 106.7° C., Mw/Mn = 1.2) | 2 wt. parts |

A toner II-2 was prepared in the same manner as in Example II-1 except for using the above ingredients in place of those used in Example II-1.

The composition and properties of the thus-prepared toner II-2 are shown in Tables 7 and 8, respectively.

Example II-3

| | |
|---|---|
| Binder resin II-a | 70 wt. parts |
| Binder resin II-e | 30 wt. parts |
| Magnetic iron oxide (spherical, $D_{AV}$ = 0.20 $\mu$m) | 100 wt. parts |
| Mono-azo iron complex (formula VI) | 3 wt. parts |
| Higher alcohol ($T_{HAP}$ = 99° C., Mw/Mn = 1.94) | 2 wt. parts |

A toner II-3 was prepared in the same manner as in Example II-1 except for using the above ingredients in place of those used in Example II-1.

The composition and properties of the thus-prepared toner II-3 are shown in Tables 7 and 8, respectively.

Comparative Example II-1

| | |
|---|---|
| Binder resin II-a | 5 wt. parts |
| Binder resin II-e | 95 wt. parts |
| Magnetic iron oxide (spherical, $D_{AV}$ = 0.20 $\mu$m) | 100 wt. parts |
| 3,5-di-t-butylsalicylic acid Al compound (formula VIII) | 3 wt. parts |
| Mono-azo iron complex (formula VI) | 1 wt. parts |
| Fischer-Tropshe wax ($T_{HAP}$ = 88° C., Mw/Mn = 1.3) | 4 wt. parts |

A toner II-4 was prepared in the same manner as in Example II-1 except for using the above ingredients in place of those used in Example II-1.

The composition and properties of the thus-prepared toner II-4 are shown in Tables 7 and 8, respectively.

Example II-4

| | |
|---|---|
| Binder resin II-a | 70 wt. parts |
| Binder resin II-d | 30 wt. parts |

-continued

| | |
|---|---|
| Carbon black | 10 wt. parts |
| Mono-azo iron complex (formula VI) | 2 wt. parts |
| Fischer-Tropshe wax ($T_{HAP}$ = 88° C., Mw/Mn = 1.3) | 4 wt. parts |

A toner II-5 was prepared in the same manner as in Example II-1 except for using the above ingredients in place of those used in Example II-1.

The composition and properties of the thus-prepared toner II-5 are shown in Tables 7 and 8, respectively.

Example II-5

| | |
|---|---|
| Binder resin II-a | 90 wt. parts |
| Binder resin II-d | 10 wt. parts |
| Carbon black | 10 wt. parts |
| Mono-azo chromium complex (formula VII) | 3 wt. parts |
| Low-molecular weight polypropylene ($T_{HAP}$ = 145° C., Mw/Mn = 8.8) | 4 wt. parts |

A toner II-6 was prepared in the same manner as in Example II-1 except for using the above ingredients in place of those used in Example II-1.

The composition and properties of the thus-prepared toner II-6 are shown in Tables 7 and 8, respectively.

Comparative Example II-2

| | |
|---|---|
| Binder resin II-a | 10 wt. parts |
| Binder resin II-f | 90 wt. parts |
| Carbon black | 10 wt. parts |
| Mono-azo iron complex (formula VI) | 1 wt. parts |
| Low-molecular weight polypropylene ($T_{HAP}$ = 145° C., Mw/Mn = 8.8) | 4 wt. parts |

A toner II-7 was prepared in the same manner as in Example II-1 except for using the above ingredients in place of those used in Example II-1.

The composition and properties of the thus-prepared toner II-7 are shown in Tables 7 and 8, respectively.

Comparative Example II-3

| | |
|---|---|
| Binder resin II-b | 50 wt. parts |
| Binder resin II-d | 50 wt. parts |
| Magnetic iron oxide (spherical, $D_{AV}$ = 0.20 $\mu$m) | 100 wt. parts |
| 3,5-di-t-butylsalicylic acid Cr compound (formula IX) | 1 wt. parts |
| Low-molecular weight polyethylene ($T_{HAP}$ = 126° C., Mw/Mn = 1.5) | 2 wt. parts |

A toner II-8 was prepared in the same manner as in Example II-1 except for using the above ingredients in place of those used in Example II-1.

The composition and properties of the thus-prepared toner II-8 are shown in Tables 7 and 8, respectively.

Comparative Example II-4

| | |
|---|---|
| Binder resin II-e | 30 |
| Binder resin II-d | 70 " |
| Carbon black | 10 " |
| 3,5-di-t-butylsalicylic acid Cr compound (formula VII) | 6 " |
| Low-molecular weight polypropylene ($T_{HAP}$ = 145° C., Mw/Mn = 8.8) | 4 " |

A toner II-9 was prepared in the same manner as in Example II-1 except for using the above ingredients in place of those used in Example II-1.

The composition and properties of the thus-prepared toner II-9 are shown in Tables 7 and 8, respectively.

Comparative Example II-5

| | |
|---|---|
| Binder resin II-a | 5 wt. parts |
| Binder resin II-g | 95 wt. parts |
| Carbon black | 10 wt. parts |
| Mono-azo chromium complex (formula VII) | 1 wt. parts |
| Low-molecular weight polypropylene ($T_{HAP}$ = 145° C., Mw/Mn = 8.8) | 4 wt. parts |

A toner II-10 was prepared in the same manner as in Example II-1 except for using the above ingredients in place of those used in Example II-1.

The composition and properties of the thus-prepared toner II-10 are shown in Tables 7 and 8, respectively.

With respect to the binder resins used in the above Examples II-1 to II-5 and Comparative Examples II-1 to II-5, respective two binder resins were dry-blended each other to prepare corresponding resin compositions II-1 to II-3, II-5, II-7, II-4, II-6 and II-8 to II-10, respectively, as shown in Table 9 appearing hereinafter.

The properties of the resin compositions II-1 to II-10 are also shown in Table 9.

The above-prepared toners II-1 to II-10 were evaluated with respect to the following items, respectively.

Low-temperature Fixability

Each of the toners II-1 to II-4 and II-8 was subjected to (yet-unfixed) image formation by using an image forming apparatus ("Laser Jet 8100", mfd. by Hewlett-Packard Co.) rom which a fixing device was removed to form a yet-unfixed halftone image (comprising one-dot and two-space pattern) on paper at a toner coverage of 0.3 mg/cm$^2$.

The removed fixing device was provided with an external drive and a temperature control unit. The above-formed yet-unfixed halftone image was fixed by using the external fixing device under conditions including a fixation temperature of 150° C. and a process speed of 235 mm/sec.

The thus-formed fixed toner image was rubbed with a paper ("Dasper", mfd. by Ozu Sangyo K.K.) at a load of 50 g/cm$^2$, whereby an image density lowering percentage (IDLP) after the rubbing was measured relative to the image density before the rubbing.

Each of the toners II-5 to II-7, II-9 and II-10 was subjected to (yet-unfixed) image formation by using an image forming apparatus ("Color Laser Shot LBP2160", mfd. by Canon K.K.) from which a fixing device was removed to form a yet-unfixed solid black image (comprising one-dot and two-space pattern) on paper at a toner coverage of 0.2 mg/cm$^2$.

The removed fixing device was provided with an external drive and a temperature control unit. The above-formed yet-unfixed halftone black image was fixed by using the external fixing device under conditions including a fixation temperature of 150° C. and a process speed of 117 mm/sec.

The thus-formed fixed toner image was rubbed with a paper ("Dasper", mfd. by Ozu Sangyo K.K.) at a load of 50 g/cm$^2$, whereby an image density lowering percentage (IDLP) after the rubbing was measured relative to the image density before the rubbing.

Anti-hot Offset Performance

Similarly as in the evaluation of the low-temperature fixability for each of the toners II-1 to II-4 and II-8, a yet-unfixed solid black image (toner coverage=0.6 mg/cm$^2$) was fixed by using the external fixing device at a fixation temperature of 235° C. and a process speed of 145 mm/sec. The fixed toner image was observed as to whether hot offset (HO) occurred or not.

Similarly as in the evaluation of the low-temperature fixability for the toners II-5 to II-7, II-9 an II-10, a yet-unfixed solid black image (toner coverage=0.4 mg/cm$^2$) was fixed by using the external fixing device at a fixation temperature of 240° C. and a process speed of 117 mm/sec. The fixed toner image was observed as to whether hot offset (HO) occurred or not.

(Evaluation Standard)

A: Not occurred at all.

B: Slight offset occurred but was at a practically acceptable level.

C: Offset readily recognizable with eyes occurred but was at a practically acceptable level.

D: Remarkable offset occurred.

E: Paper was wound about the roller.

Wax Dispersibility

With respect of each of the toners II-1 to II-10, fine powder fraction and medium powder fraction (average particle size of 7.0 $\mu$m) of toner particles classified in the classification step for toner production were subjected to measurement of a wax content (F) in fine powder fraction and a wax content (M) in medium powder fraction based on amount of heat for a peak attributable to wax by using a differential scanning calorimeter ("DSC-7", mfd. by Perkin-Elmer Corp.) to obtain a ratio (F/M) of the wax content (F) in fine powder fraction to the wax content (M) in medium powder fraction.

Developing Performance

Each of the toners II-1 to II-4 and II-8 was subjected to image formation on 20,000 sheets (durability test) of a solid black image (printing areal percentage=4%) under an environment of 32.5° C. and 85% RH by using an image forming apparatus ("Laser Jet 8100", mfd. by Hewlett-Packard Co.) while supplying A4-size paper in a longitudinal direction at an image forming speed of 32 sheets/min.

With respect to the thus-formed solid black image on A4-size paper, an image density was measured at an initial stage and after the durability test (on 20,000 sheets) by using a Macbeth densitometer (available from Macbeth Co.) to evaluate the developing performance.

Each of the toners II-5 to II-7, II-9 and II-10 was subjected to image formation on 20,000 sheets (durability test) of a solid black image (printing areal percentage=4%) under an environment of 32.5° C. and 85% RH by using an image forming apparatus ("Color Laser Shot LBP2160", mfd. by Canon K.K.) while supplying A4-size paper in a longitudinal direction at an image forming speed of 24 sheets/min.

With respect to the thus-formed solid black image on A4-size paper, an image density was measured at an initial stage and after the durability test (on 20,000 sheets) by using a Macbeth densitometer (available from Macbeth Co.) to evaluate the developing performance.

Soiling on Separation Claw (of Fixing Device)

After the above-mentioned durability test (on 20,000 sheets), a state of a separation claw of a fixing device was observed as to whether the separation claw was soiled by toner particles.

(Evaluation Standard)

A: No toner attachment occurred at all.

B: Toner attachment occurred but the trace of the separation claw was not observed on the solid black image after the durability test on 20,000 sheets.

C: Toner attachment occurred and the trace of the separation claw was observed as a white portion on the solid black image after the durability test on 20,000 sheets.

Soiling on Developing Sleeve

After the above-mentioned evaluation of the developing performance, toner particles remaining on the developing sleeve were cleaned by air blow, followed by observation with eyes as to whether soiling on the developing sleeve occurred or not.

(Evaluation Standard)

A: No toner attachment occurred at all.

B: Toner attachment occurred in a thin layer but did not affect the resultant image.

C: Toner attachment occurred and an image density of a solid black image after the durability test on 20,000 sheets was lowered.

Soiling on Photosensitive Drum

After the evaluation of the developing performance a state of the photosensitive drum surface was observed by eyes as to whether the photosensitive drum was soiled by toner particles.

(Evaluation Standard)

A: No toner attachment occurred at ail.

B: Toner attachment occurred but did not affect the resultant image.

C: Toner attachment occurred and the trace of toner melt-sticking on the photosensitive drum was 10 observed as a white portion on the solid black image after the durability test on 20,000 sheets.

The results of evaluation for the above items are shown in Table 10 appearing hereinafter.

TABLE 6

| Binder | Polyester monomers *1 (mol. %) | | | | | | Vinyl monomers *2 (wt. %) | | | Proportion of vinyl monomers | THF-insoluble content | Molecular weight distribution (%) 1 × 10$^4$– | | |
|---|---|---|---|---|---|---|---|---|---|---|---|---|---|---|
| resin No. | BPA-PO | BPA-EO | TPA | SA | TMA | FA | Styrene | BA | EHA | (wt. %) | (wt. %) | <1 × 10$^4$ | 5 × 10$^4$ | 5 × 10$^4$< |
| II-a | 35 | 15 | 15 | — | 0.1 | 34.9 | — | — | — | 100 | 0 | 73.2 | 26.6 | 0.2 |
| II-b | — | — | — | — | — | — | 83 | 17 | — | 0 | 0 | 12.7 | 36.8 | 50.5 |

TABLE 6-continued

| Binder resin No. | Polyester monomers *1 (mol. %) BPA-PO | BPA-EO | TPA | SA | TMA | FA | Vinyl monomers *2 (wt. %) Styrene | BA | EHA | Proportion of vinyl monomers (wt. %) | THF-insoluble content (wt. %) | Molecular weight distribution (%) <1 × $10^4$ | 1 × $10^4$–5 × $10^4$ | 5 × $10^4$< |
|---|---|---|---|---|---|---|---|---|---|---|---|---|---|---|
| II-c | 35 | 15 | 11 | — | 22 | 17 | 84 | — | 16 | 85 | 35.1 | 43.7 | 37.5 | 18.7 |
| II-d | 35 | 15 | 30 | 15 | 5 | — | 84 | — | 16 | 75 | 6.7 | 51.3 | 34.5 | 14.2 |
| II-e | 35 | 15 | — | — | 15 | 35 | 84 | — | 16 | 95 | 19.8 | 55.3 | 29 | 15.7 |
| II-f | 15 | 35 | — | — | 31 | 19 | 84 | — | 16 | 90 | 43.2 | 42.5 | 37 | 20.5 |
| II-g | 15 | 35 | — | — | 41 | 9 | 84 | — | 16 | 90 | 49.5 | 40.5 | 38 | 21.5 |

*1, *2 = same as in Table 1.
SA: succinic acid derivative
BA: butyl acrylate

TABLE 7

| Ex. No. | Toner No. | Resin 1 No. | Resin 1 wt. parts | Resin 2 No. | Resin 2 wt. parts | Colorant Species | Colorant wt. parts | Metal compound 1* Species | Metal compound 1* wt. parts | Metal compound 2 Species | Metal compound 2 wt. parts | Wax Species | Wax wt. parts |
|---|---|---|---|---|---|---|---|---|---|---|---|---|---|
| Ex. II-1 | II-1 | II-a | 30 | II-c | 70 | Magnetic iron oxide | 100 | Al compound | 2 | Monoazo Fe compound | 1 | Polyethylene | 2 |
| Ex. II-2 | II-2 | II-a | 30 | II-e | 70 | Magnetic iron oxide | 100 | Al compound | 1 | — | — | " | 2 |
| Ex. II-3 | II-3 | II-a | 70 | II-e | 30 | Magnetic iron oxide | 100 | — | — | Monoazo Fe compound | 3 | Higher alcohol | 2 |
| Comp. Ex. II-1 | II-4 | II-a | 5 | II-c | 95 | Magnetic iron oxide | 100 | Al compound | 2 | Monoazo Fe compound | 1 | Fischer-Tropshe wax | 4 |
| Ex. II-4 | II-5 | II-a | 70 | II-d | 30 | Carbon black | 10 | — | — | Monoazo Fe compound | 2 | Fischer-Tropshe wax | 4 |
| Ex. II-5 | II-6 | II-a | 90 | II-d | 10 | Carbon black | 10 | Al compound | — | Monoazo Cr compound | 3 | Polypropylene | 4 |
| Comp. Ex. II-2 | II-7 | II-a | 10 | II-f | 90 | Carbon black | 10 | — | — | Monoazo Fe compound | 1 | " | 4 |
| Comp. Ex. II-3 | II-8 | II-b | 50 | II-d | 50 | Magnetic iron oxide | 100 | Cr compound | 1 | — | — | Polyethylene | 2 |
| Comp. Ex. II-4 | II-9 | II-e | 30 | II-d | 70 | Carbon black | 10 | — | — | Monoazo Cr compound | 6 | Polypropylene | 4 |
| Comp. Ex. II-5 | II-10 | II-a | 5 | II-g | 95 | Carbon black | 10 | — | — | Monoazo Cr compound | 1 | " | 4 |

*= same as in Table 2.

TABLE 8

| Ex. No. | Toner No. | $T_{HPA}$ for toner (° C.) | THFins. (wt. %) | Molecular weight distribution of toner (%) M1 (<1 × $10^4$) | M2 (1 × $10^4$–5 × $10^4$) | M3 (5 × $10^4$<) | M4 (10 × $10^4$≦) | W1 (mol. %) | W2 (mol. %) | W2 − W1 |
|---|---|---|---|---|---|---|---|---|---|---|
| Ex. II-1 | II-1 | 104.4 | 33.1 | 52.5 | 34.3 | 13.2 | 9.1 | 10.9 | 15.6 | 4.7 |
| Ex. II-2 | II-2 | 104.4 | 29.8 | 60.7 | 28.3 | 11.0 | 6.2 | 9.1 | 11.4 | 2.3 |
| Ex. II-3 | II-3 | 102.9 | 12.6 | 67.8 | 27.3 | 4.9 | 0.7 | 3.5 | 6.0 | 2.4 |
| Comp. Ex. II-1 | II-4 | 86.3 | 35.7 | 45.2 | 37.0 | 17.8 | 12.1 | 17.2 | 18.3 | 1.1 |
| Ex. II-4 | II-5 | 86.3 | 1.2 | 66.6 | 29.0 | 4.4 | 0.3 | 0.9 | 1.7 | 0.8 |
| Ex. II-5 | II-6 | 139.7 | 0.6 | 69.5 | 27.4 | 3.1 | 0 | 0.4 | 0.7 | 0.3 |
| Comp. Ex. II-2 | II-7 | 139.7 | 10.4 | 45.6 | 35.9 | 18.5 | 13.7 | 23.4 | 26.5 | 3.1 |
| Comp. Ex. II-3 | II-8 | 125.4 | 3.5 | 32.0 | 35.6 | 32.4 | 28.1 | 2.9 | 1.3 | −1.6 |
| Comp. Ex. II-4 | II-9 | 139.7 | 9.8 | 53.2 | 34.9 | 11.9 | 5.7 | 7.8 | 7.4 | −0.4 |
| Comp. Ex. II-5 | II-10 | 139.7 | 46.3 | 42.1 | 37.5 | 20.4 | 15.9 | 33.7 | 36.1 | 2.4 |

TABLE 9

| | Resin composition | Resin 1 | | Resin 2 | | Molecular weight distribution (%) | | | | |
|---|---|---|---|---|---|---|---|---|---|---|
| | | | | | | $<1\times10^4$ | $1\times10^4$–$5\times10^4$ | $5\times10^4<$ | $(10\times10^4\leqq)$ | THFins. |
| Ex. No. | No. | species | wt. parts | species | wt. parts | m1 | m2 | m3 | m4 | (wt. %) |
| Ex. II-1 | II-1 | II-a | 30 | II-c | 70 | 52.55 | 34.3 | 13.15 | 10.7 | 24.57 |
| Ex. II-2 | II-2 | II-a | 30 | II-e | 70 | 60.67 | 28.28 | 11.05 | 7.1 | 13.86 |
| Ex. II-3 | II-3 | II-a | 70 | II-e | 30 | 67.83 | 27.32 | 4.85 | 1.5 | 5.94 |
| Comp. Ex. II-1 | II-4 | II-a | 5 | II-c | 95 | 43.14 | 36.6 | 20.26 | 15.3 | 33.35 |
| Ex. II-4 | II-5 | II-a | 70 | II-d | 30 | 66.63 | 28.97 | 4.4 | 1.2 | 2.01 |
| Ex. II-5 | II-6 | II-a | 90 | II-d | 10 | 71.01 | 27.39 | 1.60 | 0.1 | 0.67 |
| Comp. Ex. II-2 | II-7 | II-a | 10 | II-f | 90 | 45.57 | 35.96 | 18.47 | 14.7 | 38.88 |
| Comp. Ex. II-3 | II-8 | II-b | 50 | II-d | 50 | 32 | 35.65 | 32.35 | 29.1 | 3.35 |
| Comp. Ex. II-4 | II-9 | II-e | 30 | II-d | 70 | 52.5 | 32.85 | 14.65 | 8.5 | 10.63 |
| Comp. Ex. II-5 | II-10 | II-a | 5 | II-g | 95 | 42.135 | 37.43 | 20.435 | 16.3 | 47.03 |

TABLE 10

| | | F/M | IDLP at | HO at | Image density | | Separation | Sleeve | Drum |
|---|---|---|---|---|---|---|---|---|---|
| Ex. No. | Toner No. | (for wax) | 160° C. | 240° C. | Initial | After 20,000 sheets | claw soiling | soiling | soiling |
| Ex. II-1 | II-1 | 1.02 | 1.2 | A | 1.49 | 1.50 | A | A | A |
| Ex. II-2 | II-2 | 1.05 | 3.1 | A | 1.50 | 1.46 | A | A | A |
| Ex. II-3 | II-3 | 1.10 | 2.3 | B | 1.44 | 1.49 | A | A | A |
| Comp. Ex. II-1 | II-4 | 1.32 | 6.5 | A | 1.48 | 1.49 | A | A | A |
| Ex. II-4 | II-5 | 1.28 | 3.9 | C | 1.47 | 1.40 | A | A | A |
| Ex. II-5 | II-6 | 1.30 | 2.5 | C | 1.50 | 1.39 | A | B | A |
| Comp. Ex. II-2 | II-7 | 1.20 | 8.7 | A | 1.49 | 1.36 | A | B | B |
| Comp. Ex. II-3 | II-8 | 1.35 | 23.3 | C | 1.41 | 1.26 | C | A | A |
| Comp. Ex. II-4 | II-9 | 1.37 | 12.3 | D | 1.39 | 1.11 | B | A | A |
| Comp. Ex. II-5 | II-10 | 1.45 | 25.7 | B | 1.45 | 1.08 | A | C | C |

What is claimed is:

1. A toner, comprising: at least a binder resin, a colorant and a wax, wherein the binder resin has been formed from monomers including a vinyl monomer and polyester-forming monomers containing at least a polybasic carboxylic acid having three or more carboxyl groups or its anhydride, and comprises at least a hybrid resin comprising a vinyl polymer unit and a polyester unit, the toner contains a THF (tetrahydrofuran)-soluble content which includes a first component having a molecular weights of below $1\times10^4$ containing W1 (mol. %) of the polybasic carboxylic acid and its anhydride based on the polyester-forming monomers contained in the first component and a second component having a molecular weight of at least $1\times10^4$ containing W2 (mol. %) of the polybasic carboxylic acid and its anhydride based on the polyester-forming monomers contained in the second component, W1 and W2 satisfying the following relationship:

$$0.1\times W2<W2-W1<0.5\times W2,$$

$$0\leqq W1<30,$$

$$0<W2<50, \text{ and}$$

$$W2>W1,$$

the THF-soluble content provides a GPC (gel permeation chromatography) chromatogram including 40–70 wt. % (M1) of a component having molecular weights of below $1\times10^4$, 25–50 wt. % (M2) of a component having molecular weights of $1\times10^4$–$5\times10^4$, 2–25 wt. % (M3) of a component having molecular weights of above $5\times10^4$, and below 10 wt. % (M4) of a component having molecular weights of at least $10\times10^4$, M1, M2 and M3 satisfying the following relationship:

$$M1\geqq M2>M3.$$

2. The toner according to claim 1, wherein the binder resin is a blend of two or more species of resins selected from the group consisting of (i) a blend of a hybrid resin comprising a vinyl polymer unit and a polyester unit and another hybrid resin comprising a vinyl polymer unit and a polyester unit, (ii) a blend of a polyester resin and a hybrid resin comprising a vinyl polymer unit and a polyester unit, (iii) a blend of a vinyl polymer and a hybrid resin comprising a vinyl polymer unit and a polyester unit, and (iv) a blend of a polyester resin, a vinyl polymer and a hybrid resin comprising a vinyl polymer unit and a polyester unit.

3. The toner according to claim 1, wherein W1 and W2 satisfy the following relationship:

$$1<W1<25 \text{ and } 2<W2<30.$$

4. The toner according to claim 1, wherein W1 and W2 satisfy the following relationship:

$$3\leqq W1<20 \text{ and } 3<W2\leqq 20.$$

5. The toner according to claim 1, wherein W1 and W2 provide a difference therebetween satisfying the following relationship:

$$0<W2-W1<10.$$

6. The toner according to claim 1, wherein the binder resin comprises a blend of a hybrid resin comprising a vinyl polymer unit and a polyester unit and another hybrid resin comprising a vinyl polymer unit and a polyester unit, and the toner contains a THF-insoluble content of at most 25 wt. %.

7. The toner according to claim 6, wherein the THF-insoluble content is in the range of 1–15 wt. %.

8. The toner according to claim 1, wherein the binder resin comprises a polyester resin and a hybrid resin comprising a vinyl polymer unit and a polyester unit, and the toner contains a THF-insoluble content of 1–50 wt. %.

9. The toner according to claim 8, wherein the THF-insoluble content is in the range of 2–40 wt. %.

10. The toner according to claim 1, wherein the THF-soluble content of the toner includes a component having molecular weights of below $1\times10^4$ containing Wa (wt. %) of the vinyl polymer unit and a component having molecular weights of at least $1\times10^4$ containing Wb (wt. %) of the vinyl polymer unit, Wa and Wb providing a difference therebetween satisfying the following relationship:

$$|Wa-Wb|<20.$$

11. The toner according to claim 10, wherein Wa and Wb satisfy the following relationships:

$$0<Wa<50 \text{ and } 0<Wb<30.$$

12. The toner according to claim 10, wherein Wa and Wb satisfy the following relationships:

$$5<Wa<30 \text{ and } 0<Wb<20.$$

13. The toner according to claim 10, wherein Wa and Wb satisfy the following relationships:

$$Wa\geqq Wb.$$

14. The toner according to claim 1, wherein the toner has been prepared through a step of melt-kneading a mixture comprising at least a resin composition comprising (i) a blend of a hybrid resin comprising a vinyl polymer unit and a polyester unit and another hybrid resin comprising a vinyl polymer unit and polyester unit, as the binder resin, the colorant and the wax;

the binder resin has been formed from monomers including a vinyl monomer and polyester-forming monomers containing at least a polybasic carboxylic acid having three or more carboxyl groups or its anhydride;

the resin composition contains a THF (tetrahydrofuran)-soluble content which includes a first component having molecular weights of below $1\times10^4$ containing w1 (mol. %) of the polybasic carboxylic acid and its anhydride based on the polyester-forming monomers contained in the first component and a second component having molecular weight of at least $1\times10^4$ containing w2 (mol. %) of the polybasic carboxylic acid and its anhydride based on the polyester-forming monomers contained in the second component, w1 and w2 satisfying the following relationship:

$$0.1\times w2<w2-w1<0.5\times w2$$

$$0\leqq w1<30,$$

$$0<w2<50, \text{ and}$$

$$w2>w1,$$

the THF-soluble content provides a GPC (gel permeation chromatography) chromatogram including 40–75 wt. % (m1) of a component having molecular weights of below $1\times10^4$, 23–45 wt. % (m2) of a component having molecular weights of $1\times10^4$–$5\times10^4$, 2–25 wt. % (m3) of a component having molecular weights of above $5\times10^4$, and below 13 wt. % (m4) of a component having molecular weights of at least $10\times10^4$, m1, m2 and m3 satisfying the following relationship:

$$m1\geqq m2>m3.$$

15. The toner according to claim 14, wherein w1 and w2 satisfy the following relationship:

$$1<w1<25 \text{ and } 2<w2<30.$$

16. The toner according to claim 14, wherein w1 and w2 satisfy the following relationship:

$$3\leqq w1<20 \text{ and } 3<w2\leqq 20.$$

17. The toner according to claim 14, wherein w1 and w2 provide a difference therebetween satisfying the following relationship:

$$0<w2-w1<10.$$

18. The toner according to claim 16, wherein the resin composition comprises a blend of a hybrid resin comprising a vinyl polymer unit and a polyester unit and another hybrid resin comprising a vinyl polymer unit and a polyester unit, and the toner contains a THF-insoluble content of at most 30 wt. %.

19. The toner according to claim 18, wherein the THF-insoluble content is in the range of 1–20 wt. %.

20. The toner according to claim 14, wherein the resin composition comprises a polyester resin and a hybrid resin comprising a vinyl polymer unit and a polyester unit, and contains a THF-insoluble content of 1–50 wt. %.

21. The toner according to claim 20, wherein the HF-insoluble content is in the range of 2–40 wt. %.

22. The toner according to claim 1, wherein the THF-soluble content provides a GPC chromatogram including 50–75 wt. % (m1) of a component having molecular weights of below $1\times10^4$, 23–45 wt. % (m2) of a component having molecular weights of $1\times10^4$–$5\times10^4$, 2–25 wt. % (m3) of a component having molecular weights of above $5\times10^4$, and below 10 wt. % (m4) of a component having molecular weights of at least $10\times10^4$, m1, m2, m3 and m4 satisfying the following relationship:

$$m1\geqq m2>m3>m4.$$

23. The toner according to claim 1, wherein the toner provides a DSC (differential scanning calorimetry) curve on temperature increase including at least one heat-absorption peak in a temperature range of 60–120° C.

24. The toner according to claim 1, wherein the wax provides a DSC curve on temperature increase including at least one heat-absorption peak in a temperature range of 60–120° C.

25. The toner according to claim 1, wherein the wax has a GPC molecular weight distribution showing a ratio Mw/Mn of 1.0–2.0 between weight-average molecular weight (Mw) and number-average molecular weight (Mn).

26. The toner according to claim 1, wherein the toner further comprises a metal compound in an amount of 0.1–10 wt. parts per 100 wt. parts of the binder resin.

27. The toner according to claim 26, wherein the metal compound comprises an organic metal compound.

28. The toner according to claim 27, wherein the organic metal compound comprises an aromatic hydroxycarboxylic acid compound.

29. The toner according to claim 27, wherein the organic metal compound comprises an aromatic hydroxycarboxylic acid aluminum compound.

30. The toner according to claim 27, wherein the organic metal compound comprises a mono-azo iron complex.

31. The toner according to claim 27, wherein the organic metal compound comprises a mixture of an aromatic hydroxycarboxylic acid aluminum compound and a mono-azo iron complex.

32. The toner according to claim 27, wherein the toner comprises a magnetic toner containing a magnetic material as the colorant in an amount of 30–200 wt. parts per 100 wt. parts of the bonder resin.

33. A resin composition for a toner, comprising:

at least a hybrid resin comprising a vinyl polymer unit and a polyester unit, wherein the resin composition has been formed from monomers including a vinyl monomer and polyester-forming monomers containing at least a polybasic carboxylic acid having three or more carboxyl groups or its anhydride, the resin composition contains a THF (tetrahydrofuran)-soluble content which includes a first component having molecular weights of below $1\times10^4$ containing w1 (mol. %) of the polybasic carboxylic acid and its anhydride based on the polyester-forming monomers contained in the first component and a second component having molecular weight of at least $1\times10^4$ containing w2 (mol. %) of the polybasic carboxylic acid and its anhydride based on the polyester-forming monomers contained in the second component, w1 and w2 satisfying the following relationship:

$$0.1\times w2<w2-w1<0.5\times w2,$$

$$0\leqq w1<30,$$

$$0<w2<50, \text{ and}$$

$$w2>w1,$$

the THF-soluble content provides a GPC (gel permeation chromatography) chromatogram including 40–75 wt. % (m1) of a component having molecular weights of below $1\times10^4$, 23–45 wt. % (m2) of a component having molecular weights of $1\times10^4$–$5\times10^4$, 2–25 wt. % (m3) of a component having molecular weights of above $5\times10^4$, and below 13 wt. % (m4) of a component having molecular weights of at least $10\times10^4$, m1, m2, and m3 satisfying the following relationship:

$$m1\geqq m2>m3.$$

34. The composition according to claim 33, wherein the resin composition is a blend of two or more species of resins selected from the group consisting of (i) a blend of a hybrid resin comprising a vinyl polymer unit and a polyester unit and another hybrid resin comprising a vinyl polymer unit and a polyester unit, (ii) a blend of a polyester resin and a hybrid resin comprising a vinyl polymer unit and a polyester unit, (iii) a blend of a vinyl polymer and a hybrid resin comprising a vinyl polymer unit and a polyester unit, and (iv) a blend of a polyester resin, a vinyl polymer and a hybrid resin comprising a vinyl polymer unit and a polyester unit.

35. The composition according to claim 33, wherein w1 and 22 satisfy the following relationship:

$$1<w1<25 \text{ and } 2<w2<30.$$

36. The composition according to claim 33, wherein w1 and w2 satisfy the following relationship:

$$3\leqq w1<20 \text{ and } 3<w2\leqq 20.$$

37. The composition according to claim 33, wherein w1 and w2 provide a difference therebetween satisfying the following relationship:

$$0<w2-w1<10.$$

38. The composition according to claim 33, wherein the THF-soluble content provides a GPC chromatogram including 50–75 wt. % (m1) of a component having molecular weights of below $1\times10^4$, 23–45 wt. % (m2) of a component having molecular weights of $1\times10^4$–$5\times10^4$, 2–25 wt. % (m3) of a component having molecular weights of above $5\times10^4$, and below 10 wt. % (m4) of a component having molecular weights of at least $10\times10^4$, m1, m2, m3 and m4 satisfying the following relationship:

$$m1\geqq m2>m3>m4.$$

39. The composition according to claim 33, wherein the resin composition comprises a blend of a hybrid resin comprising a vinyl polymer unit and a polyester unit and another hybrid resin comprising a vinyl polymer unit and a polyester unit, and the toner contains a THF-insoluble content of at most 30 wt. %.

40. The composition according to claim 39, wherein the THF-insoluble content is in the range of 1–20 wt. %.

41. The composition according to claim 33, wherein the resin composition comprises a polyester resin and a hybrid resin comprising a vinyl polymer unit and a polyester unit, and contains a THF-insoluble content of 1–50 wt. %.

42. The composition according to claim 41, wherein the THF-insoluble content is in the range of 2–40 wt. %.

* * * * *

UNITED STATES PATENT AND TRADEMARK OFFICE

CERTIFICATE OF CORRECTION

PATENT NO. : 6,485,875 B1
DATED : November 26, 2002
INVENTOR(S) : Yuki Karaki et al.

It is certified that error appears in the above-identified patent and that said Letters Patent is hereby corrected as shown below:

Column 1,
Line 11, “electrophoto-graphic” should read -- electrophotographic --; and
Line 38, “a” (2nd occurrence) should be deleted.

Column 2,
Line 50, “fails” should read -- fail --.

Column 7,
Line 53, “85,” should read -- 805, --.

Column 8,
Line 49, “is” should read -- are --.

Column 9,
Line 38, “on to” should read -- on --;
Line 44, “a real” should read -- areal --; and
Line 55, “$>1\times10^4$)” should read -- $\geqq1\times10^4$) --.

Column 10,
Line 37, “he” should read -- the --; and
Line 43, “group” should read -- groups --.

Column 12,
Line 56, “(THAP)” should read -- ($T_{HAP}$) --.

Column 13,
Line 14, “added” should read -- be added --;
Line 38, “complexes” should read -- complexes, --; and
Line 51, “homologous” should read -- homologs --.

Column 15,
Exhibit VII, “Fe” should read -- Cr --.

Column 20,
Line 12, “component.” should read -- components. --; and
Line 41, “cyclohexanon,” should read -- cyclohexanone, --.

UNITED STATES PATENT AND TRADEMARK OFFICE

CERTIFICATE OF CORRECTION

PATENT NO. : 6,485,875 B1
DATED : November 26, 2002
INVENTOR(S) : Yuki Karaki et al.

It is certified that error appears in the above-identified patent and that said Letters Patent is hereby corrected as shown below:

Column 30,
Line 20, “(excepet” should read -- (except -- and “uesd” should read -- used --;
Line 22, “dry-blended” should read -- dry-blended with --; and
Line 32, “rom” should read -- from --.

Column 32,
Line 8, “intensity” should read -- intensely --; and
Line 14, “solid” should read -- soiled --.

Column 31,
Table 1, “Terephtharic” should read -- Terephthalic --.

Column 40,
Line 35, “each” should read -- with each --; and
Line 47, “rom” should read -- from --.

Column 42,
Line 51, “10” should be deleted.

Column 45,
Line 45, “weights” should read -- weight --.

Column 48,
Line 27, “claim 16,” should read -- claim 14, --.

UNITED STATES PATENT AND TRADEMARK OFFICE

CERTIFICATE OF CORRECTION

PATENT NO. : 6,485,875 B1
DATED : November 26, 2002
INVENTOR(S) : Yuki Karaki et al.

It is certified that error appears in the above-identified patent and that said Letters Patent is hereby corrected as shown below:

Column 49,
Line 18, "bonder" should read -- binder --.

Signed and Sealed this

Ninth Day of September, 2003

JAMES E. ROGAN
*Director of the United States Patent and Trademark Office*